US011078681B1

(12) United States Patent
Mjelde

(10) Patent No.: US 11,078,681 B1
(45) Date of Patent: Aug. 3, 2021

(54) LOW PROFILE CIRCULAR DRAIN WITH WATER STOP FOR SWIMMING POOL AND DIVERTER FOR USE THEREIN

(71) Applicant: AquaStar Pool Products, Inc., Ventura, CA (US)

(72) Inventor: Olaf Mjelde, Ventura, CA (US)

(73) Assignee: AQUASTAR POOL PRODUCTS, INC., Ventura, CA (US)

( * ) Notice: Subject to any disclaimer, the term of this patent is extended or adjusted under 35 U.S.C. 154(b) by 0 days.

(21) Appl. No.: 17/146,692

(22) Filed: Jan. 12, 2021

Related U.S. Application Data

(63) Continuation-in-part of application No. 16/876,351, filed on May 18, 2020, which is a continuation-in-part of application No. 16/673,299, filed on Nov. 4, 2019, which is a continuation of application No. 16/530,659, filed on Aug. 2, 2019, now Pat. No. 10,465,404, which is a continuation of application No. 16/439,883, filed on Jun. 13, 2019, now Pat. No. 10,745,926, which is a continuation of application No. 16/210,850, filed on Dec. 5, 2018, now Pat. No. 10,323,429, which is a continuation of application No. 15/863,236, filed on Jan. 5, 2018, now Pat. No. 10,214,930, which is a continuation of application No. 15/392,345, filed on Dec. 28, 2016, now Pat. No. 9,869,103, which is a continuation of application No. 13/794,376, filed on Mar. 11, 2013, now Pat. No. 9,540,837.

(60) Provisional application No. 61/734,267, filed on Dec. 6, 2012, provisional application No. 61/660,566, filed on Jun. 15, 2012.

(51) Int. Cl.
*E04H 4/12* (2006.01)

(52) U.S. Cl.
CPC ..... *E04H 4/1236* (2013.01); *Y10T 29/49826* (2015.01)

(58) Field of Classification Search
CPC ..... E04H 4/1236
USPC ..... 4/504
See application file for complete search history.

(56) References Cited

U.S. PATENT DOCUMENTS

| | | | | |
|---|---|---|---|---|
| 3,378,858 | A | 4/1968 | Jacuzzi | |
| 3,940,807 | A | 3/1976 | Baker | |
| 4,429,832 | A | 2/1984 | Sheets | |
| 4,815,888 | A | 3/1989 | Stegmeier | |
| D351,220 | S | 10/1994 | Barnes | |
| 5,427,417 | A | 6/1995 | Lechuga | |
| 5,729,937 | A * | 3/1998 | Mantelli | E03F 3/046 52/220.5 |

(Continued)

*Primary Examiner* — Christine J Skubinna
(74) *Attorney, Agent, or Firm* — Cislo & Thomas, LLP

(57) ABSTRACT

A sump drain for installation in a surface of a swimming pool or spa, the sump drain comprising an annular chamber having a contiguous annular top opening formed by an inner side wall, an outer side wall and a bottom surface, a plurality of outlet ports, an inner and an outer water stop, a plurality of diverter plates configured to removeably couple to the inner and outer side walls of the annular chamber, each diverter plate comprising two opposed straight ends, a bottom surface having a plurality of louvers, and a pair of side walls extending from opposed sides of the bottom surface, wherein one diverter plate is placed over each outlet port, and a grid cover configured to removeably couple to the annular top opening of the chamber, the grid cover having a multiplicity of openings.

14 Claims, 22 Drawing Sheets

(56) References Cited

U.S. PATENT DOCUMENTS

| | | | |
|---|---|---|---|
| 5,734,999 | A | 4/1998 | Nicholas |
| 5,923,865 | A | 7/1999 | Chilton et al. |
| 5,996,134 | A | 12/1999 | Senninger |
| 6,109,822 | A | 8/2000 | Campbell et al. |
| 6,170,095 | B1 | 1/2001 | Zars |
| 6,230,337 | B1 | 5/2001 | Barnett |
| 6,397,408 | B1 | 6/2002 | Veloskey et al. |
| 6,419,840 | B1 | 7/2002 | Meincke |
| 6,557,588 | B2 | 5/2003 | Wright |
| 6,595,243 | B2 | 7/2003 | Tarr |
| 6,810,537 | B1 | 11/2004 | Barnes |
| 7,089,607 | B2 | 8/2006 | Barnes |
| 7,178,179 | B2 | 2/2007 | Barnes |
| D613,829 | S | 4/2010 | Griffin |
| 7,739,757 | B2 | 6/2010 | Witt |
| D621,009 | S | 8/2010 | Mjelde |
| 7,774,870 | B2 | 8/2010 | Griffin |
| 7,788,743 | B2 | 9/2010 | Mjelde |
| 7,862,729 | B2 | 1/2011 | Stetson |
| 7,992,236 | B2 | 8/2011 | Degooyer |
| 8,272,078 | B2 | 9/2012 | Snow |
| 8,281,427 | B2 | 10/2012 | Afshar |
| 8,557,109 | B1 | 10/2013 | Sutherland |
| 8,627,519 | B2 | 1/2014 | Jacobs |
| 9,540,837 | B2 | 1/2017 | Mjelde |
| 9,790,699 | B2 | 10/2017 | Mjelde |
| 9,869,103 | B1 | 1/2018 | Mjelde |
| 2005/0150040 | A1 | 7/2005 | Barber |
| 2006/0015996 | A1 | 1/2006 | Goettl |
| 2006/0015997 | A1 | 1/2006 | Barnes |
| 2006/0053544 | A1 | 3/2006 | Hui |
| 2006/0218714 | A1 | 10/2006 | Mjelde et al. |
| 2009/0019633 | A1 | 1/2009 | Snow et al. |
| 2009/0320204 | A1 | 12/2009 | Wiseman et al. |
| 2011/0162137 | A1* | 7/2011 | Kik, Sr. ..... E03F 3/046 4/613 |
| 2012/0023658 | A1 | 2/2012 | Bobeck et al. |
| 2019/0218807 | A1* | 7/2019 | Goettl ..... E04H 4/1236 |

* cited by examiner

LOW PROFILE CIRCULAR DRAIN WITH WATER STOP FOR SWIMMING POOL AND DIVERTER FOR USE THEREIN

CROSS-REFERENCE TO RELATED APPLICATIONS

This application is a continuation-in-part of U.S. patent application Ser. No. 16/876,351, entitled "Low Profile Circular Drain With Water Stop For Swimming Pool and Diverter for Use Therein," filed May 18, 2020, which is a continuation-in-part of U.S. patent application Ser. No. 16/673,299 entitled "Low Profile Circular Drain With Water Stop For Swimming Pool," filed Nov. 14, 2019, which is a continuation of U.S. patent application Ser. No. 16/530,659, now U.S. Pat. No. 10,465,404, entitled "Low Profile Circular Drain With Water Stop For Swimming Pool," filed Aug. 2, 2019, which is a continuation of U.S. patent application Ser. No. 16/439,883, now U.S. Pat. No. 10,745,926, entitled "Low Profile Circular Drain With Water Stop For Swimming Pool," filed Jun. 13, 2019, which is a continuation of U.S. patent application Ser. No. 16/210,850, now U.S. Pat. No. 10,323,429, entitled "Low Profile Circular Drain With Water Stop For Swimming Pool," filed Dec. 5, 2018, which is a continuation of U.S. patent application Ser. No. 15/863,236, now U.S. Pat. No. 10,214,930, entitled "Low Profile Circular Drain With Water Stop For Swimming Pool," filed Jan. 5, 2018, which is a continuation of U.S. patent application Ser. No. 15/392,345, now U.S. Pat. No. 9,869,103, entitled "Low Profile Circular Drain With Water Stop For Swimming Pool," filed Dec. 28, 2016, which is a continuation of U.S. patent application Ser. No. 13/794,376, now U.S. Pat. No. 9,540,837, entitled "Low Profile Circular Drain With Water Stop For Swimming Pool," filed Mar. 11, 2013, which claims priority to provisional application No. 61/660,566 filed Jun. 15, 2012 entitled "Low Profile Circular Drain Covers," and to provisional application No. 61/734,267 filed Dec. 6, 2012 entitled "Channel Drain With Water Stop," which applications are incorporated in their entirety herein by this reference.

BACKGROUND

Twin 7-Year Old Virginia Graham Baker was the granddaughter of former Secretary of State James Baker III. In June 2002 she became stuck to the hot tub drain and was unable to pull herself free and she drowned. After her tragic death the family lobbied Congress for a law to require anti-entrapment drain covers and other safety measures. As a result, The Virginia Graham Baker Pool & Spa Safety Act ("VGB Act") was enacted in December, 2007.

The 2007 VGB Act changed everything for those in business of providing swimming pool and spa suction outlets or drains. Among one of the ways of complying with the Act was separating two drains by more than three feet, such that a single individual could not likely block both drains with his or her body and become stuck. This also led to increased popularity of channel drains, rectangular and longer than three feet, which accomplished this objective but looked unsightly.

Even before the VGB Act, pool manufacturers were concerned about the aesthetic appearance of drains and were developing products and methods towards making drain covers more attractive. Among products available were small approx. 12 inch diameter round covers having a recessed upper surface forming a cavity to receive aggregate material matching the aggregate surface of the pool. Among disadvantages of this product were that the aggregate material was retained inside a portion of the cover itself, such that changing covers requires filling the new cover with matching new batch of the aggregate material. And also, these small drains are subject to being damaged by being kicked by swimmers and users of hot tubs.

Pool drains or sumps, as currently known in the art, generally comprise a plastic or fiberglass body including a chamber into which water flows from the pool as it gets recycled through the pool's pump and filter. The chamber includes an opening, or outlet port, that connects to a pipe extending to the pool pump and filter apparatus. Pipes are typically installed in gunite or shotcrete material forming the supporting walls of the pool. The terminal end of a pipe is then encased in plaster along with the drain to which it is connected. The plaster covers the gunite or shotcrete and serves as a barrier between water in the pool and the gunite or shotcrete.

As alluded to above, elongate channel sumps are popular in view of their compliance with the VGB Act, requiring swimming pool and spa sumps to prevent a person's body from covering the entire sump intake and becoming entrapped. Anti-entrapment channel sumps generally comply with the VGB Act by providing multiple intake ports, and being of a sufficient length that the ports cannot be simultaneously blocked, i.e., if one intake port is blocked, the other intake ports allow water to continue to flow into the pump and filtering system.

A problem with pool sumps, particularly elongated channel sumps, is that the plaster into which these large sumps are embedded forms cracks over time. One area most prone to form cracks is where the pool sump and plaster meet. Water may seep into the surrounding plaster and then down into the supporting walls of the pool causing damage. It therefore would be advantageous to provide a pool sump that helps prevent water from migrating down cracks as they form between the pool sump and the plaster surrounding it.

SUMMARY

In a first embodiment, the present invention is directed to a sump drain for installation in a surface of a swimming pool or spa having a drain inlet. The sump drain comprises an annular chamber having a contiguous annular top opening formed by an inner side wall, an outer side wall and a bottom surface, at least one outlet port along the bottom surface of the chamber, at least one diverter plate configured to removeably couple to the inner and outer side walls of the annular chamber, wherein the diverter plate is placed over the outlet port, and a grid cover configured to removeably couple to the annular top opening of the chamber, the grid cover having a multiplicity of openings.

Ideally, the outlet port extends downward from the bottom surface of the annular chamber.

Ideally, the sump drain further comprises an inner water stop and an outer water stop. The inner water stop is coupled to an exterior surface of the inner wall of the chamber and the outer waters stop is coupled to an exterior surface of the outer wall of the chamber. The water stops are configured to collect water seeping into cracks between the drain and plaster when the drain is installed.

Ideally, the sump drain comprises a plurality of outlet ports and a plurality of diverter plates.

In a first diverter plate embodiment, each diverter plate is curved along its length and has two opposed straight ends, a bottom surface having a plurality of louvers, and a pair of side walls extending from opposed sides of the bottom surface.

Ideally, the first diverter plate embodiment further comprises two fasteners for coupling the diverter plate to the annular chamber.

BRIEF DESCRIPTION OF THE DRAWINGS

These and other features, aspects and advantages of the present invention will become better understood with reference to the following description, appended claims, and accompanying drawings where:

DETAILED DESCRIPTION

Figure 1:
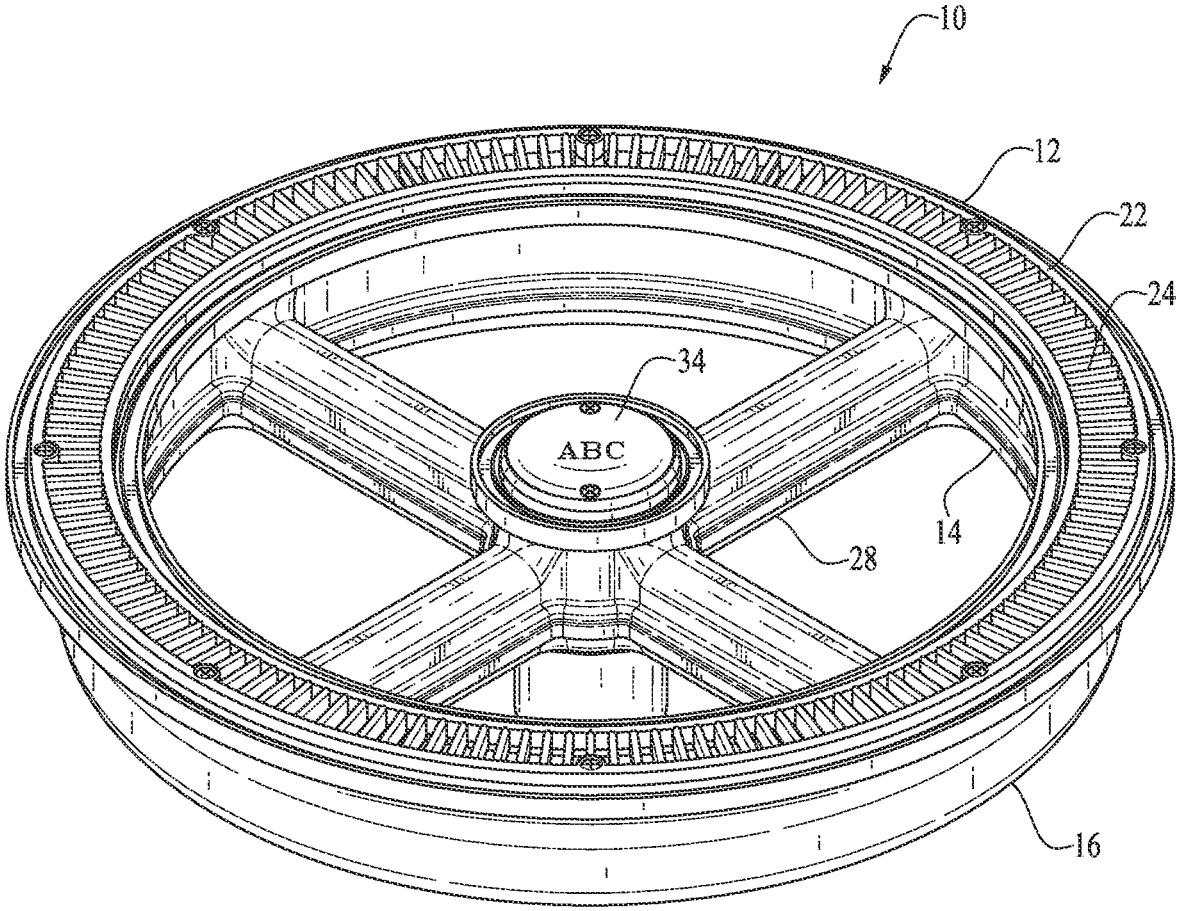
FIG. 1 is a perspective view of a first embodiment of my circular drain assembly.
Figure 2:
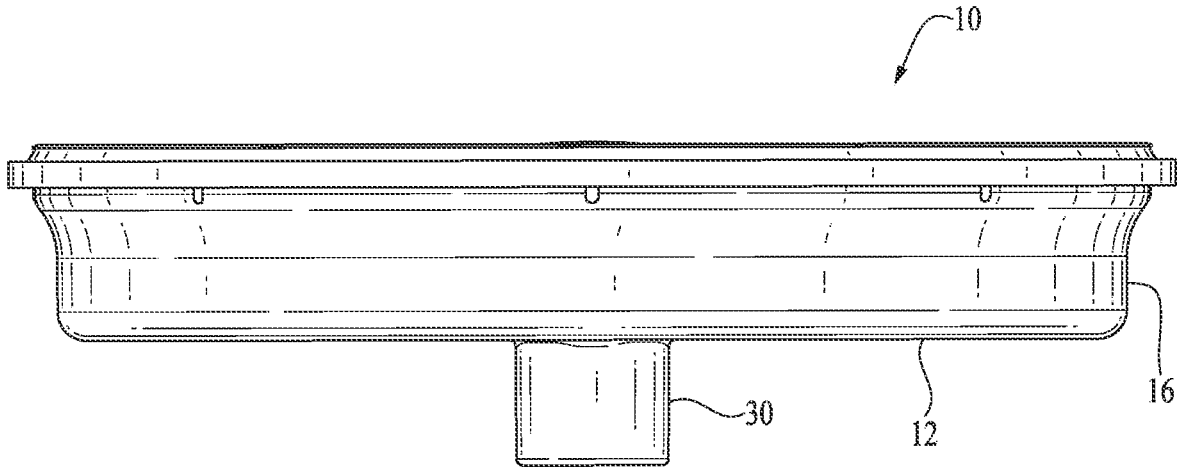
FIG. 2 is a side elevation view of the first embodiment of my circular drain assembly of FIG. 1.
Figure 3:
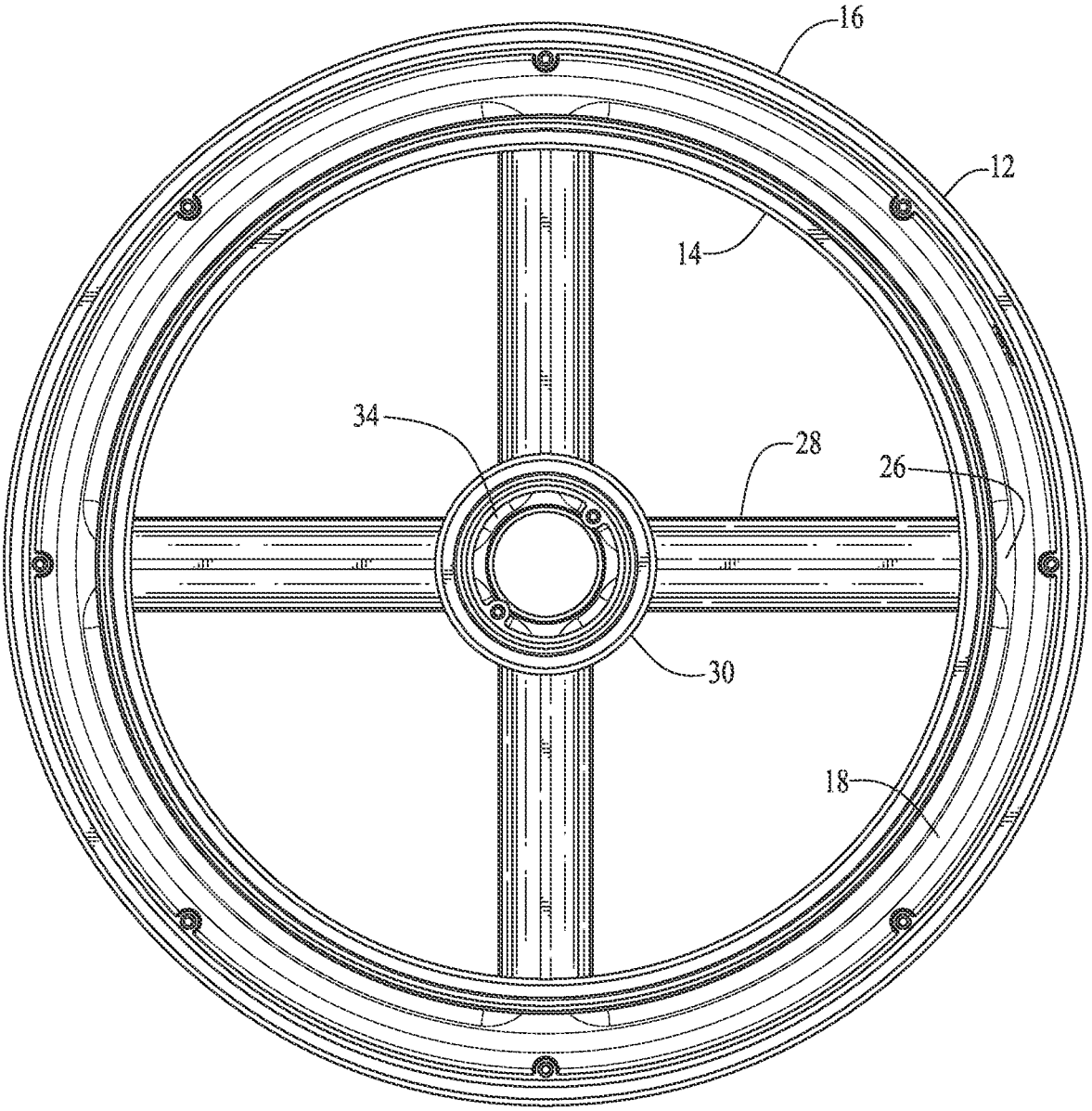
FIG. 3 is a top plan view of the first embodiment of my circular drain assembly of FIG. 1.

Referring to drawing FIGS. 1-11, the low profile circular drain 10 or suction outlet or sump of the preferred embodiment is disclosed. As best shown in FIGS. 1-3, the drain 10 has an annular ring-shaped body or chamber 12 although optionally the drain 10 may be other preferably rounded shapes such as oval or merely with rounded corners (not shown). The chamber 12 has an inner sidewall 14 having a diameter of about 18 inches (dimension D as labeled in FIG. 7) and outer sidewall 16 having an outside diameter of about 21 inches, and the depth of the chamber from top to bottom is about 3.5 inches. The top side of the chamber 12 is generally open, forming an annular or ring-shaped space 18 between the sidewalls 14, 16, which may be sized to receive a corresponding circular grid cover 22. The grid cover 22 may include a large number (here there are about 150) rectangular, radial slots 24. Optionally, the cover 22 may have other types of openings (not shown), most anything that allows water to pass through while stopping larger debris such as leaves.

The inner sidewall 16 has multiple openings or outlet ports 26 connecting to one or more conduits or pipes 28. The conduits 28 extend radially inward to a central hub 30 that connects to the pump and filtering system 32 in the floor of the pool or spa. The hub 30 preferably has about a 2.5 inch inner diameter, and its length from the bottom of the chamber 12 to the end is about 2.5 inches. The top side of the hub 30 includes a cap 34 on which a manufacturer's logo, here ABC, may be displayed, and the cap 34 is removable for purposes of cleaning out the drain 10 should it become clogged with debris. It's held on by a pair of flat head Phillips screws 36 (FIG. 5).

Figure 4:
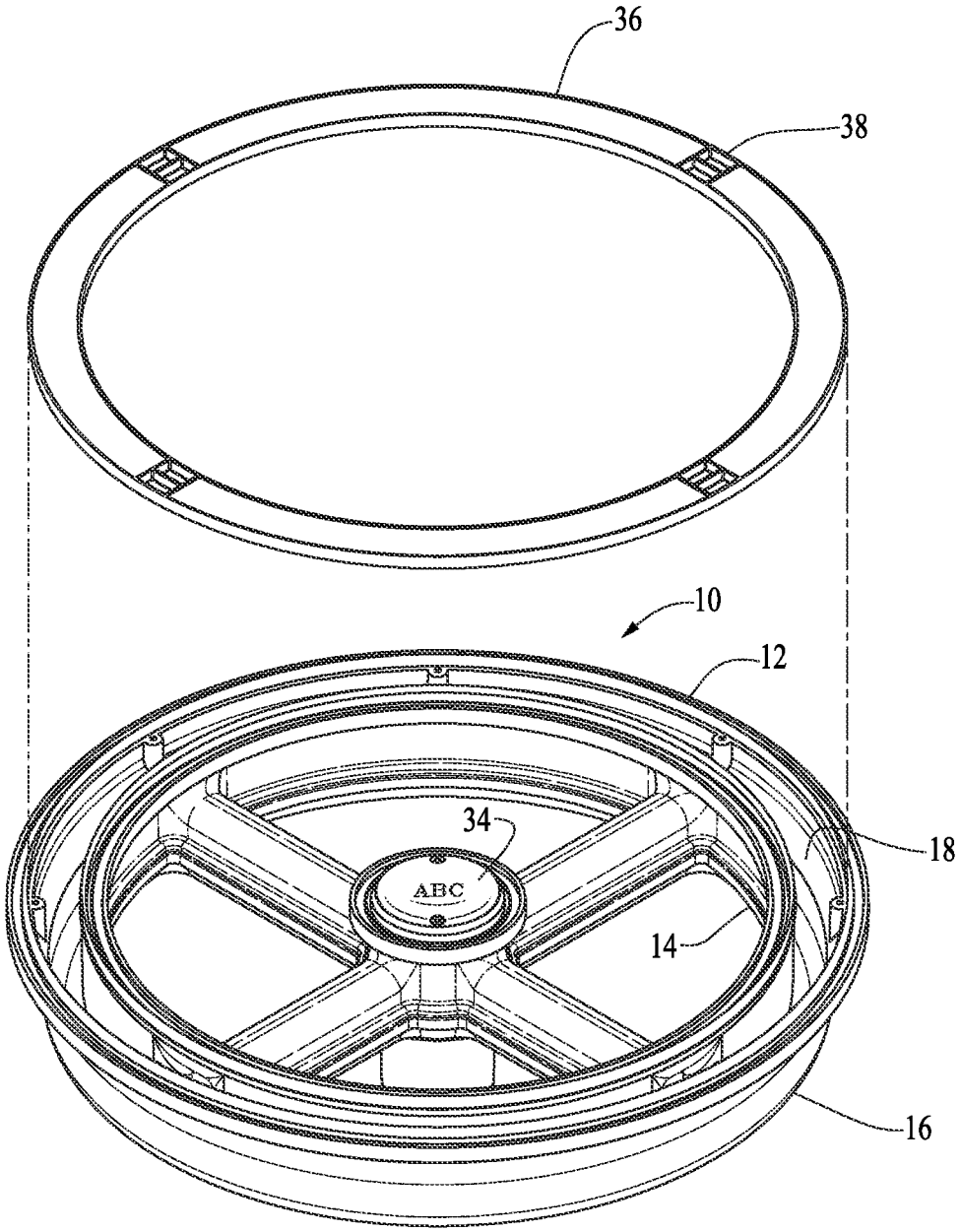
FIG. 4 is a perspective exploded view of the first embodiment of my drain assembly of FIG. 1 with the temporary plaster cover shown.
Figure 5:
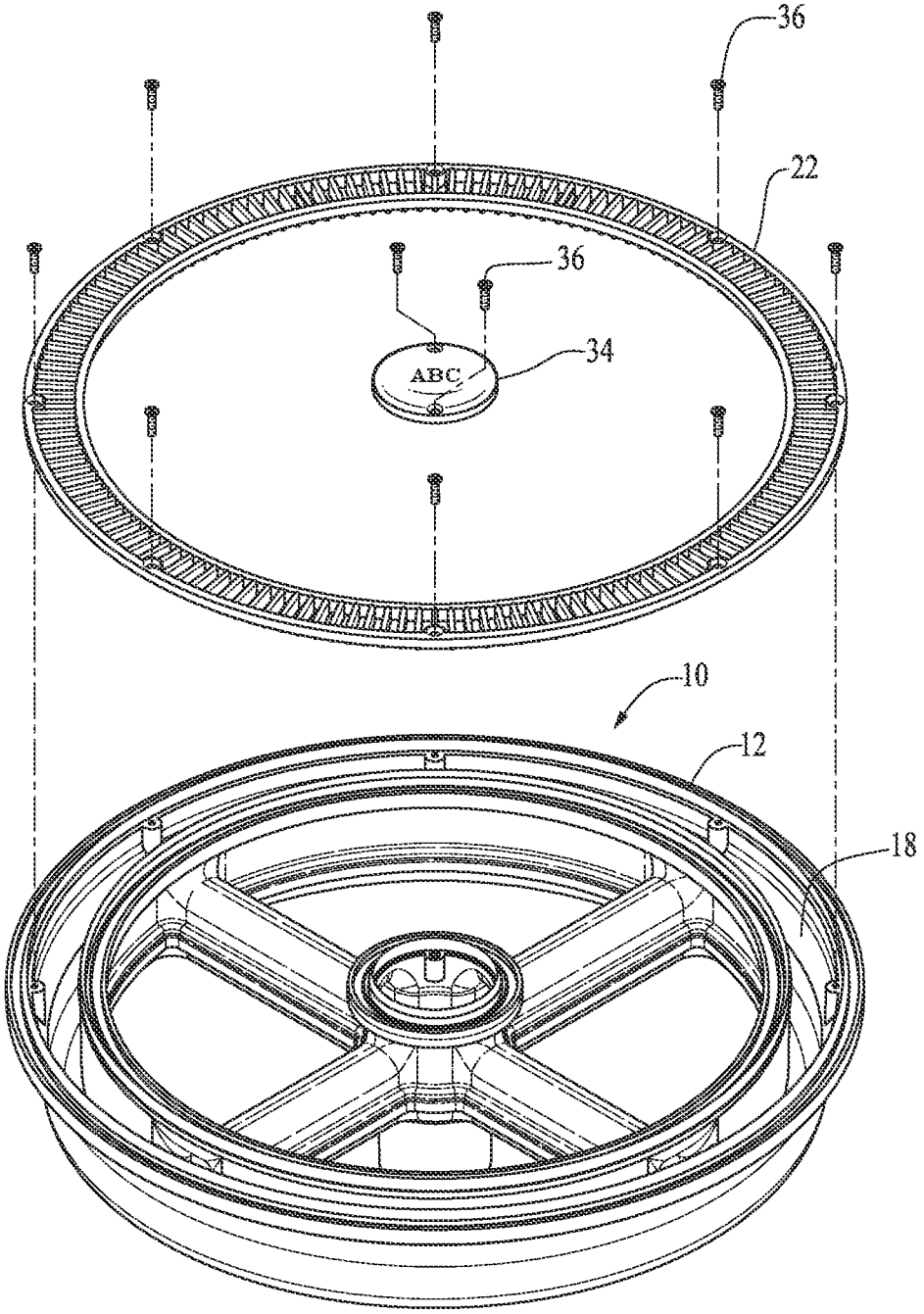
FIG. 5 is an exploded view of the first embodiment of my drain assembly of FIG. 1 with the grid cover shown as well as the removability of the center cover.
Figure 6:
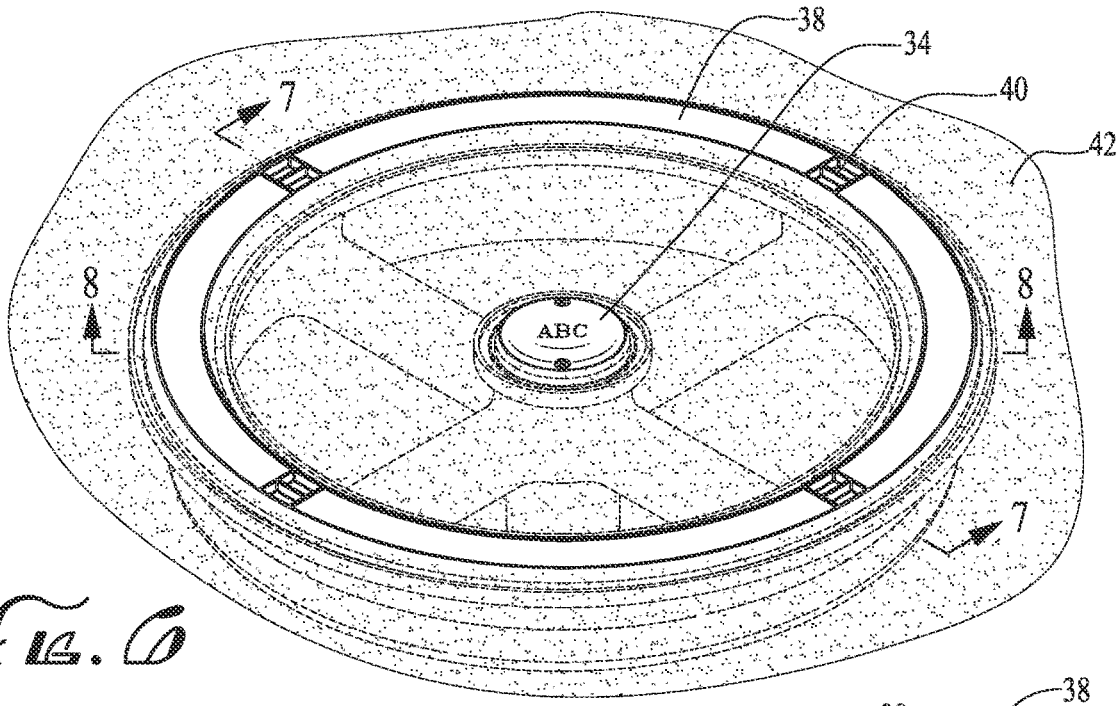
FIG. 6 is a perspective view showing the first embodiment of my drain of FIG. 1 installed into the surface of a pool with the plaster cover.
Figure 7:
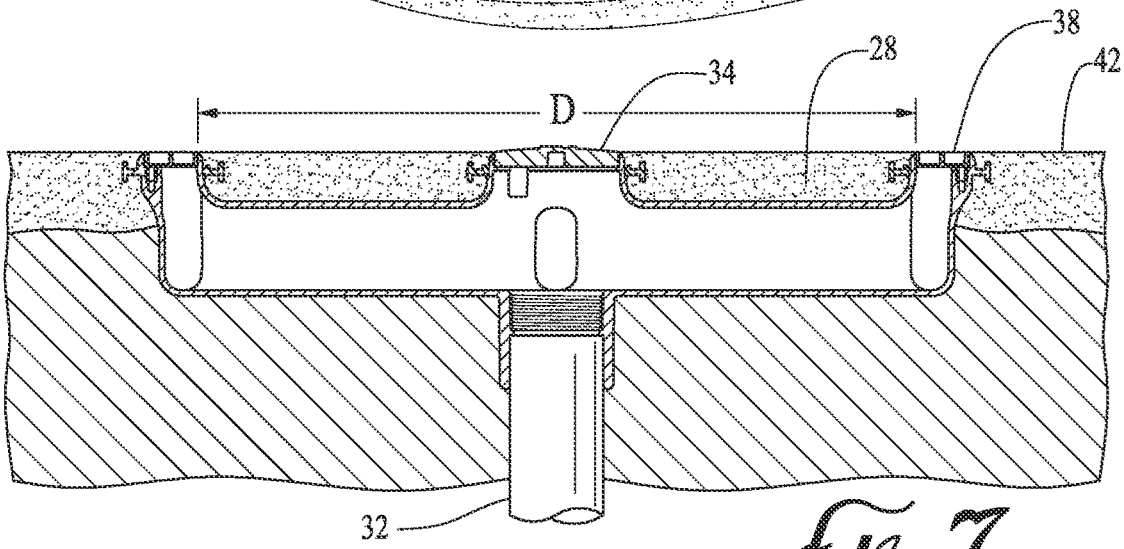
FIG. 7 is a section view taken from FIG. 6 along line 7-7.
Figure 8:
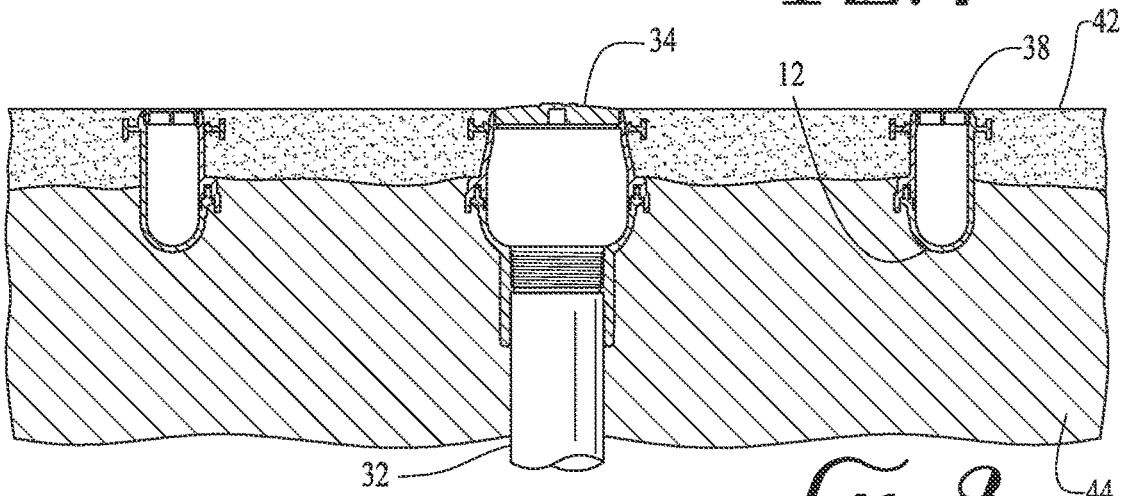
FIG. 8 is a section view taken from FIG. 6 along line 8-8.

Next referring to FIGS. 4-12, installation of the drain 10 as well as further features may be described. FIG. 4 shows a plastering cover 38 which is temporarily placed in the chamber 12 opening 18, to keep plaster from getting into the chamber 12 when the drain 10 is being installed in the floor of a pool or spa. The plastering cover 38 preferably includes several, at least two thumb/index finger holds 40 for facilitating later removal of the plastering cover 36 once the drain 10 is embedded in the pool or spa. FIG. 5 shows the grid cover 22 which is then added, held on by eight (8) screws 36. FIG. 6 shows the drain 10 being installed in the plaster surface 42 floor of a swimming pool or spa, with the plaster 42 covering up the temporary cover 38 and the center hub cap 34. Optionally, it may also be installed vertically in a lower wall of a pool or spa (not shown). FIG. 7 shows the top side opening 18 into which the plastering cover 34 fits, along with the hub cover 34 (also see FIG. 12), being substantial flush with the plaster surface 42. FIG. 8 shows that there is a substantial amount of plaster 42, as well as the underlying gunite or shotcrete material 44, between the annular chamber 12 and the center hub 30. With the drain 10 being installed in this fashion, it offers improved structural integrity in that any load from a swimmer's foot or occupant of a hot tub will impact only a small portion of the drain 10 and tend to be absorbed by the surrounding floor or wall of the pool or spa.

Figure 9:
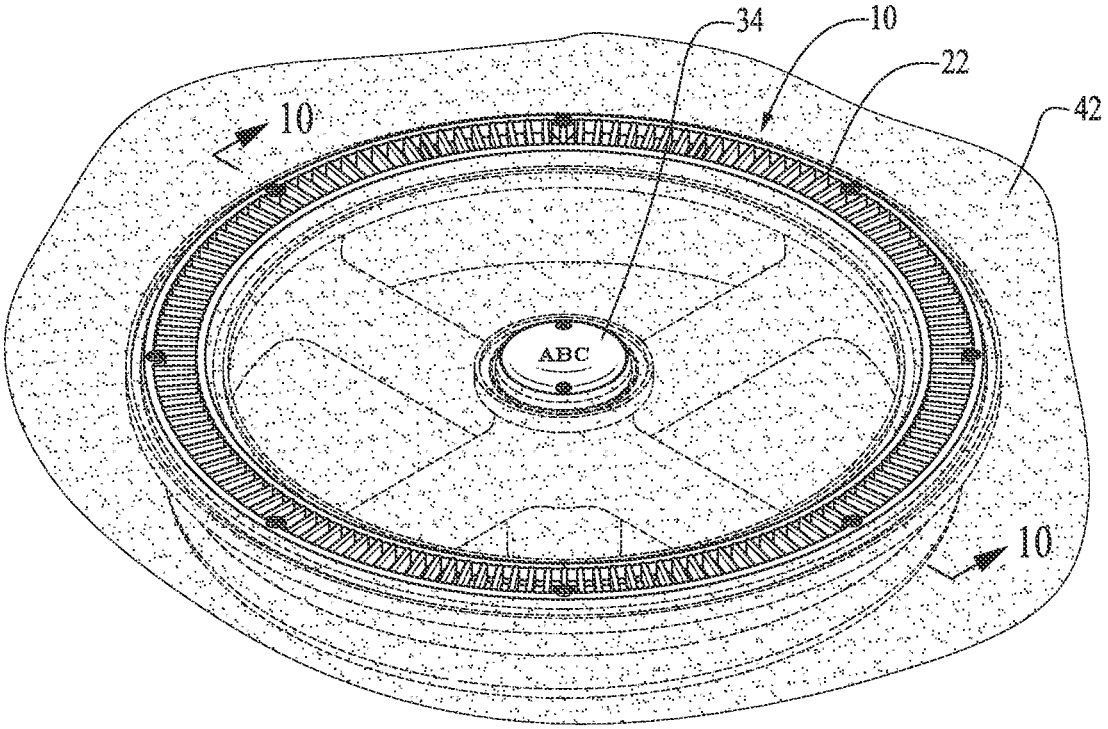
FIG. 9 is a perspective view showing the first embodiment of my drain of FIG. 5 with the grid cover installed in a pool.
Figure 10:
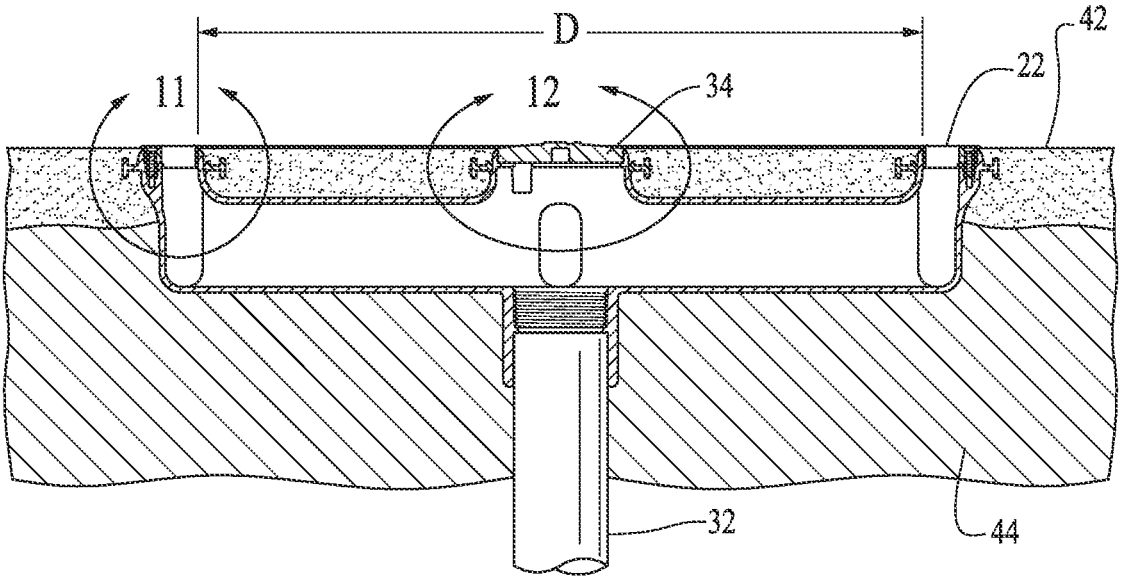
FIG. 10 is an enlarged section view taken from FIG. 9 along line 9-9, showing the grid cover installed and the water stop feature.
Figure 11:
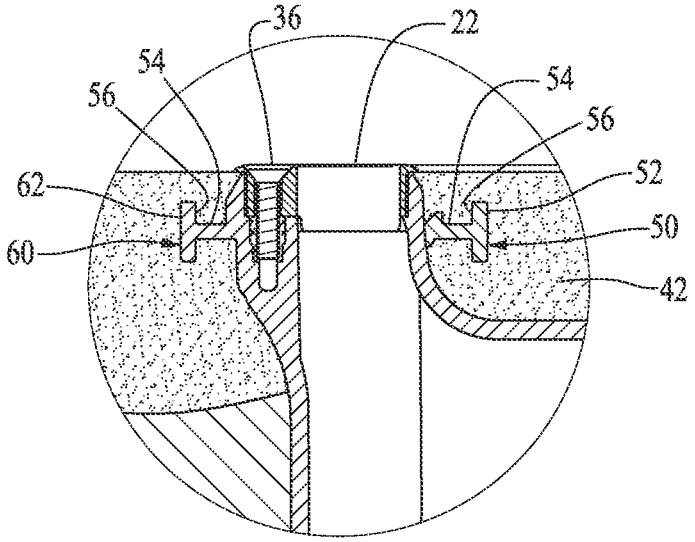
FIG. 11 is an enlarged section view of FIG. 10 taken along line 11, wherein the water stop feature is shown.

FIGS. 9, 10 shows the plastering cover 34 removed and replaced with the grid cover 22. As indicated in FIG. 5, the grid cover is secured in place in the top opening 18 by several Phillips head screws 36. Thus, the grid cover 22 and center cap 34 are the only parts of the drain 10 seen upon installation, and they blend into the plaster surface 42 of the floor of the pool or spa. FIG. 11 shows the cover 22 is substantially flush with the surrounding plaster 42, and as per FIG. 12 the center hub cap 34 is similarly substantially flush with the plaster 42 floor.

Figure 12:
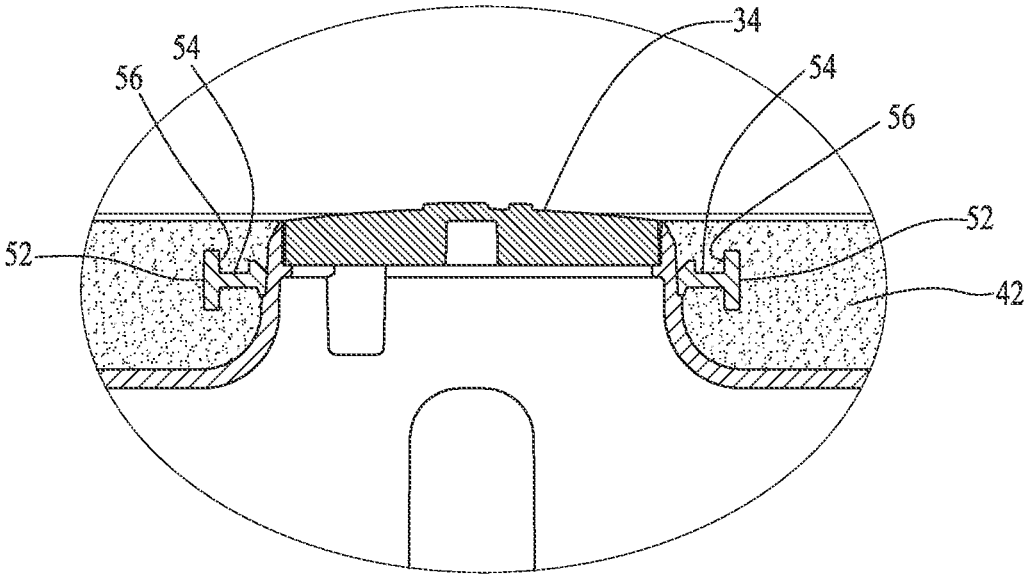
FIG. 12 is an enlarged section view of FIG. 10 taken along line 12 showing the center cover installed and again the water stop feature.
Figure 13:
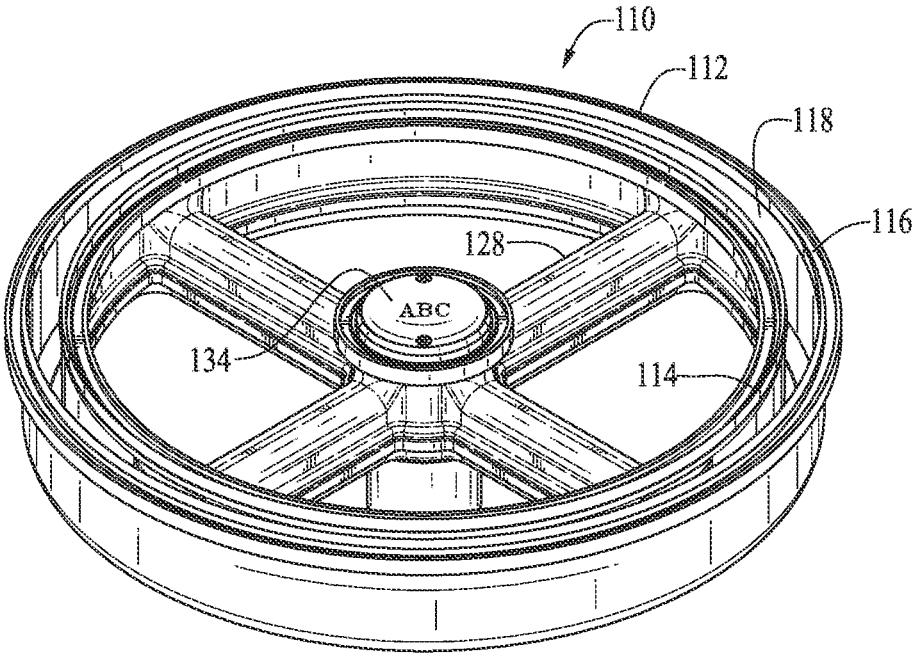
FIG. 13 is a perspective view of a second embodiment of my circular drain assembly.
Figure 14:
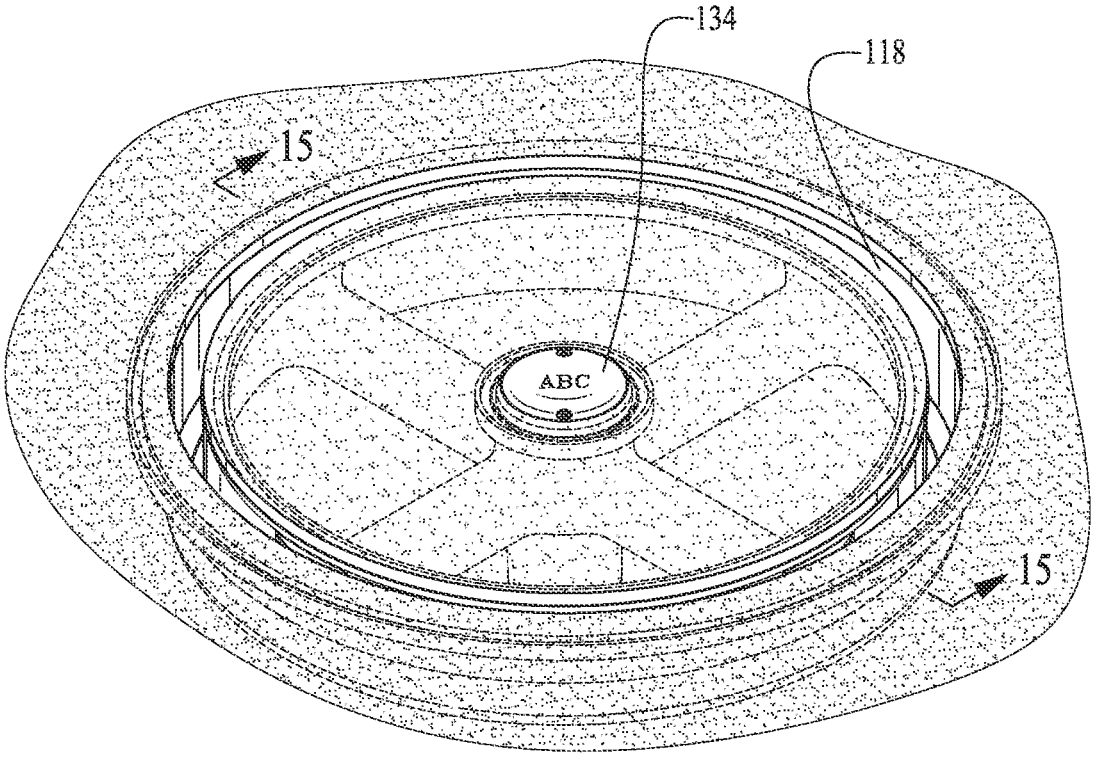
FIG. 14 is a perspective view of the second embodiment of my circular drain of FIG. 13 installed in a pool.

FIGS. 11, 12 also show water stops 50, 60 for stopping any water that intrudes between the sump 10 and plaster 42 into which the sump 10 is embedded. In the preferred embodiment the water stop 50, 60 is tray-shaped like a gutter or channel 52, 62 and extends around the sump 10 to collect water seeping into cracks between the sump 10 and the plaster 42. The water stop 50 also serves to anchor the sump 10 in the plaster 42. The gutter or channel 52 is located inboard the grid cover 22, and the same channel 52 is built in around the hub cover 34. A slightly differently configured water stop 60 is located outboard the grid cover 22, as the gutter or channel 52 is molded into the chamber body 22 adjacent to the screws 36 which attach the cover 22. Each water stop 50, 60 preferably includes a horizontal shelf 54 and a vertical wall 56, again to catch water migrating between the sump 10 and the plaster 42 in which the sump 10 is installed. The vertical wall 56 may extend above and below the horizontal shelf 54, providing an effective anchoring mechanism during sump 10 installation.

Figure 15:
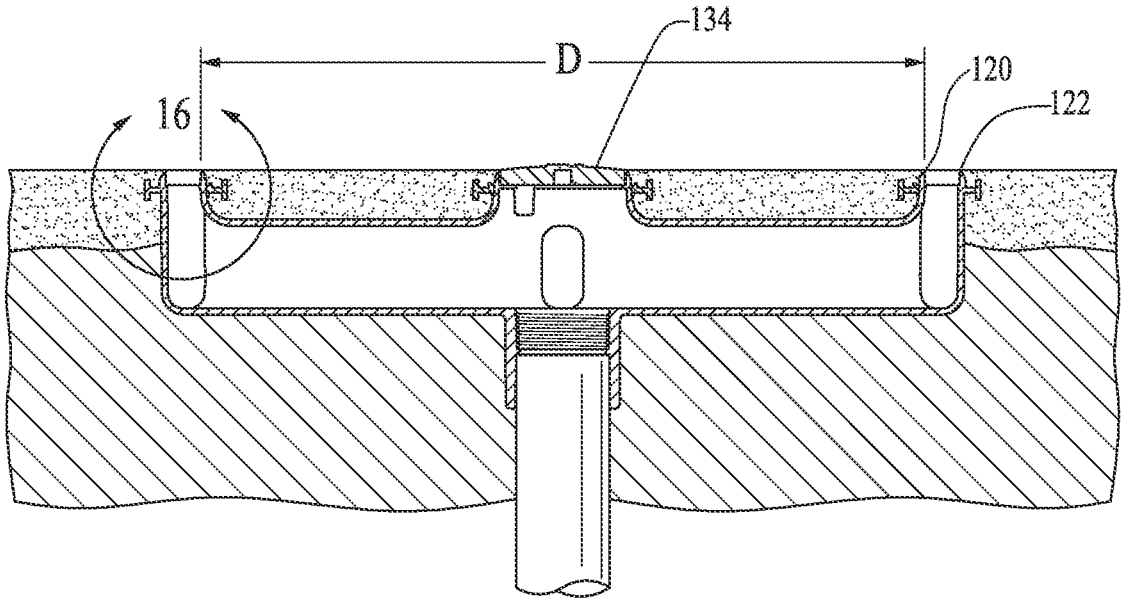
FIG. 15 is section view taken from FIG. 14 along line 15-15.
Figure 16:
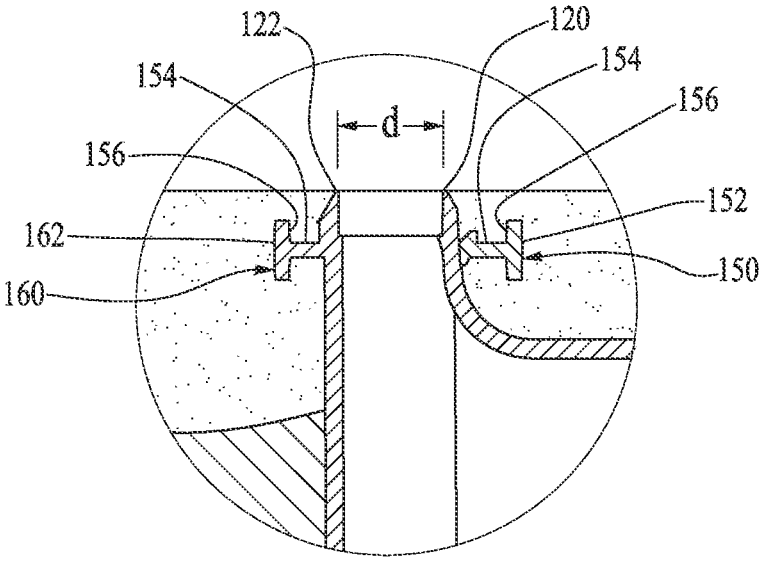
FIG. 16 is an enlarged portion of FIG. 15 taken along line 16 showing the water stop feature.

Now also referring to FIGS. 13-16, a second alternate embodiment 110 is discussed. This drain 110 has a round sump body 112, and an inner leaf trapper ring 114 and an outer leaf trapper ring 116. The leaf trapper rings 114, 116 are located concentric to each other and provide a narrow, circular gap 118 (d equals about 0.875 inches wide in FIG. 16) for water to pass but small enough to prevent larger objects from passing such as leaves. As best seen in FIGS. 15, 16, the leaf trapper rings 114, 116 have upper surfaces 120, 122 which are substantially flat and approximately align with one another. This embodiment 110 may include a temporary plaster cover 36 as described above; it does not include the circular grid cover 22.

The end result is a highly effective drain system flush with the surface of the pool, with plaster or other aggregate material having the same color and texture both inside and outside the concentric rings or circular grid. The drain has a nearly invisible, pleasing aesthetic appearance. The drain is a safe, VGB compliant drain, large enough to be unblockable by a single person. The drain is rugged, not susceptible to being easily damaged, and the water stop feature helps maintain the structural integrity of the surrounding plaster in the pool or spa floor for many years.

Figure 17:
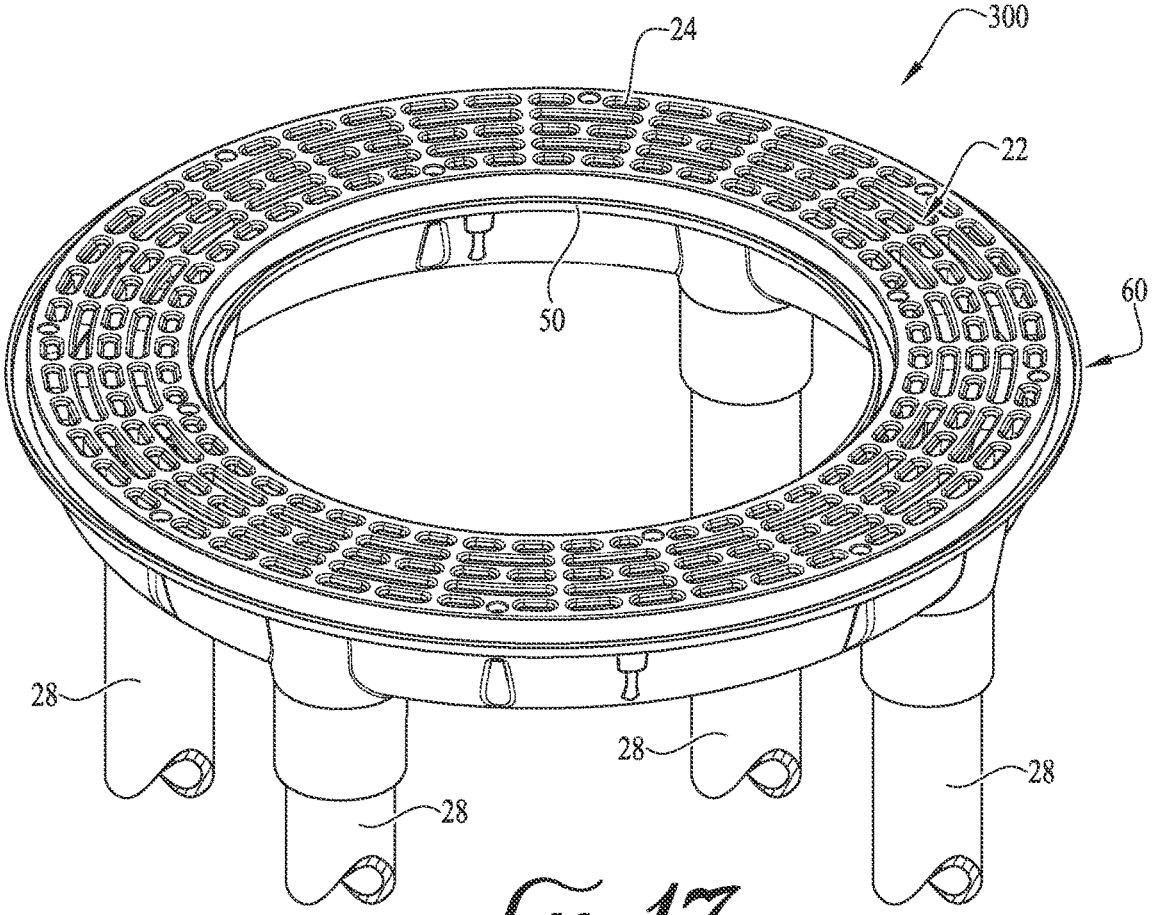
FIG. 17 is a perspective view of a third embodiment of my circular drain assembly.
Figure 18:
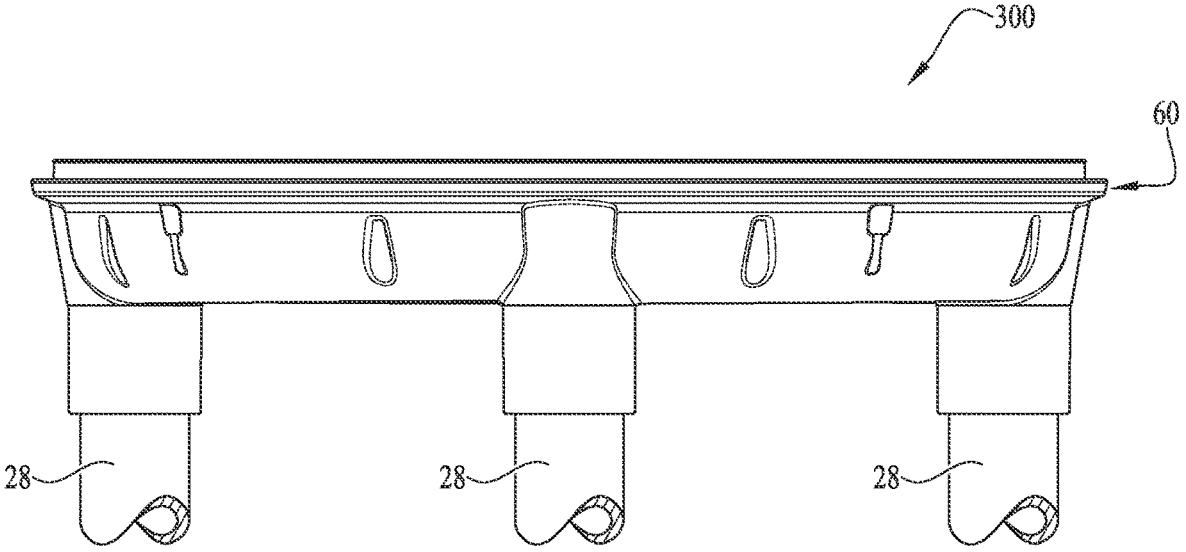
FIG. 18 is a side perspective view of the third embodiment of FIG. 17.

Referring now to FIGS. 17-24, there is shown a third circular drain embodiment 300 with a plurality of diverter plates 400 positioned within the drain 300. FIGS. 17 and 18 show the drain 300 fully assembled. This drain 300 is similar in shape and has features similar to the first and second drain embodiments 10, 110 discussed above, such as an annular ring-shaped body or chamber 12, the chamber 12 having an inner sidewall 14 and outer sidewall 16. The top side of the chamber 12 is generally open, forming an annular or ring-shaped space 18 between the sidewalls 14, 16, which may be sized to receive a corresponding circular grid cover 22. The grid cover 22 may include a large number of radial slots 24. Optionally, the cover 22 may have other types of openings (not shown), most anything that allows water to pass through while stopping larger debris such as leaves. The grid cover 22 is held on to the drain 300 by a plurality of fasteners or screws 36.

The chamber 12 has multiple openings or outlet ports 26 connecting to one or more conduits or pipes 28. The configuration of the outlet ports 26 in this drain 300 is different than the first and second drain embodiments 10, 110. Notably, each outlet port 26 is located in a bottom surface 17 of the chamber 12 and each outlet port 26 is connected to a separate conduit or pipe 28, and each conduit/pipe 28 couples to the pump and filter system in the floor of the pool or spa. Each outlet port 26 can also have a rear wall 27 (best seen in FIG. 26) that projects upward, away from the outlet port 26 and towards the grid cover 22. All dimensions discussed above with respect to the first and second embodiments 10, 110 generally apply to this drain 300.

Figure 19:
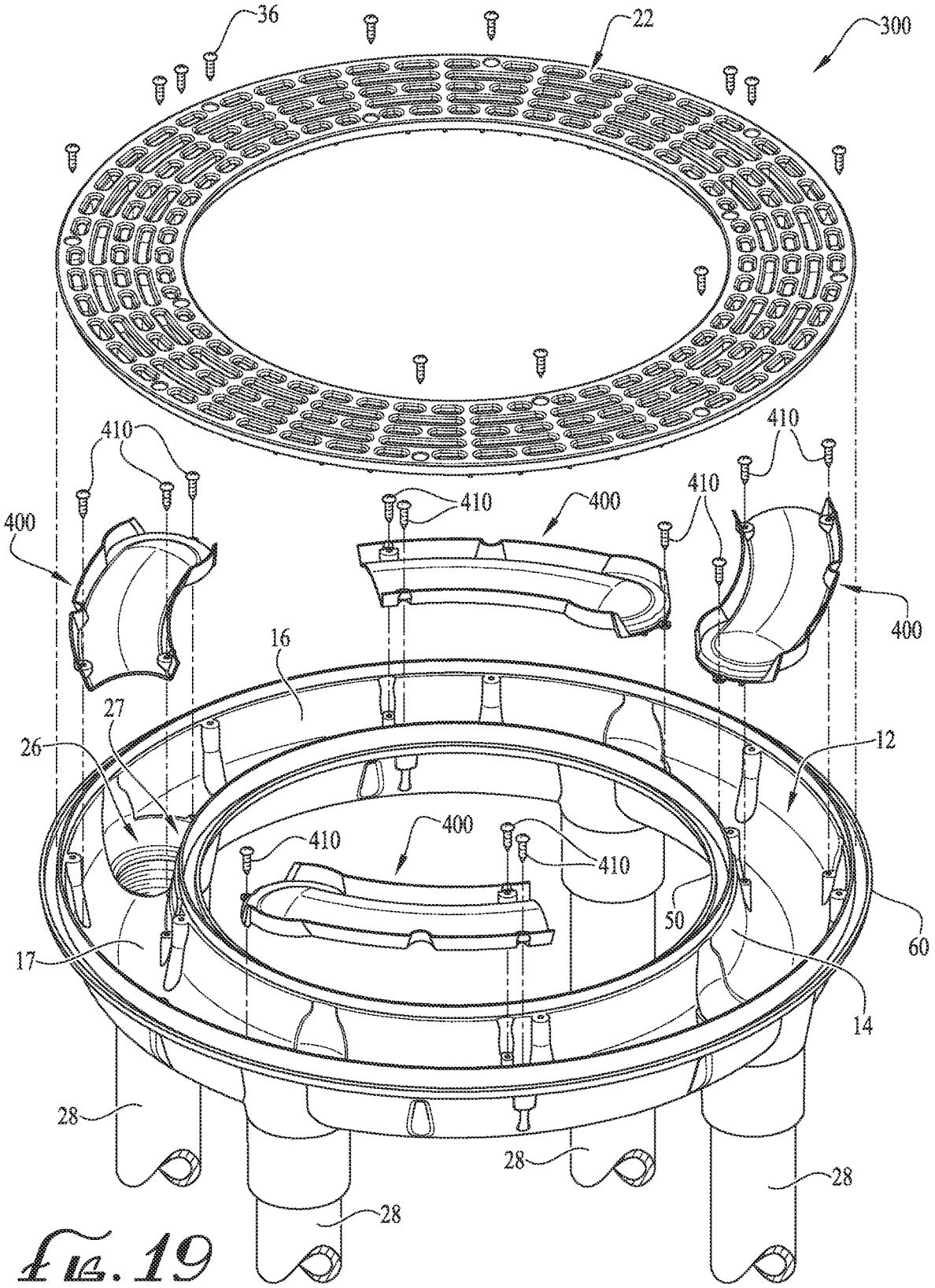
FIG. 19 is an exploded perspective view of the third embodiment of FIG. 17, wherein a plurality of diverter plates are shown and the removability of a grid cover is shown.

FIG. 19 shows all of the components of the third drain embodiment 300. Unlike the first and second embodiments 10, 110, this drain 300 has a plurality of diverter plates 400 that are removably coupled to an interior surface of the chamber 12. The number of diverter plates 400 necessary for the drain 300 corresponds to the number of outlet ports 26 the drain 300 has. In FIG. 19, there are four diverter plates 400, one for each outlet port 26.

Figure 20:
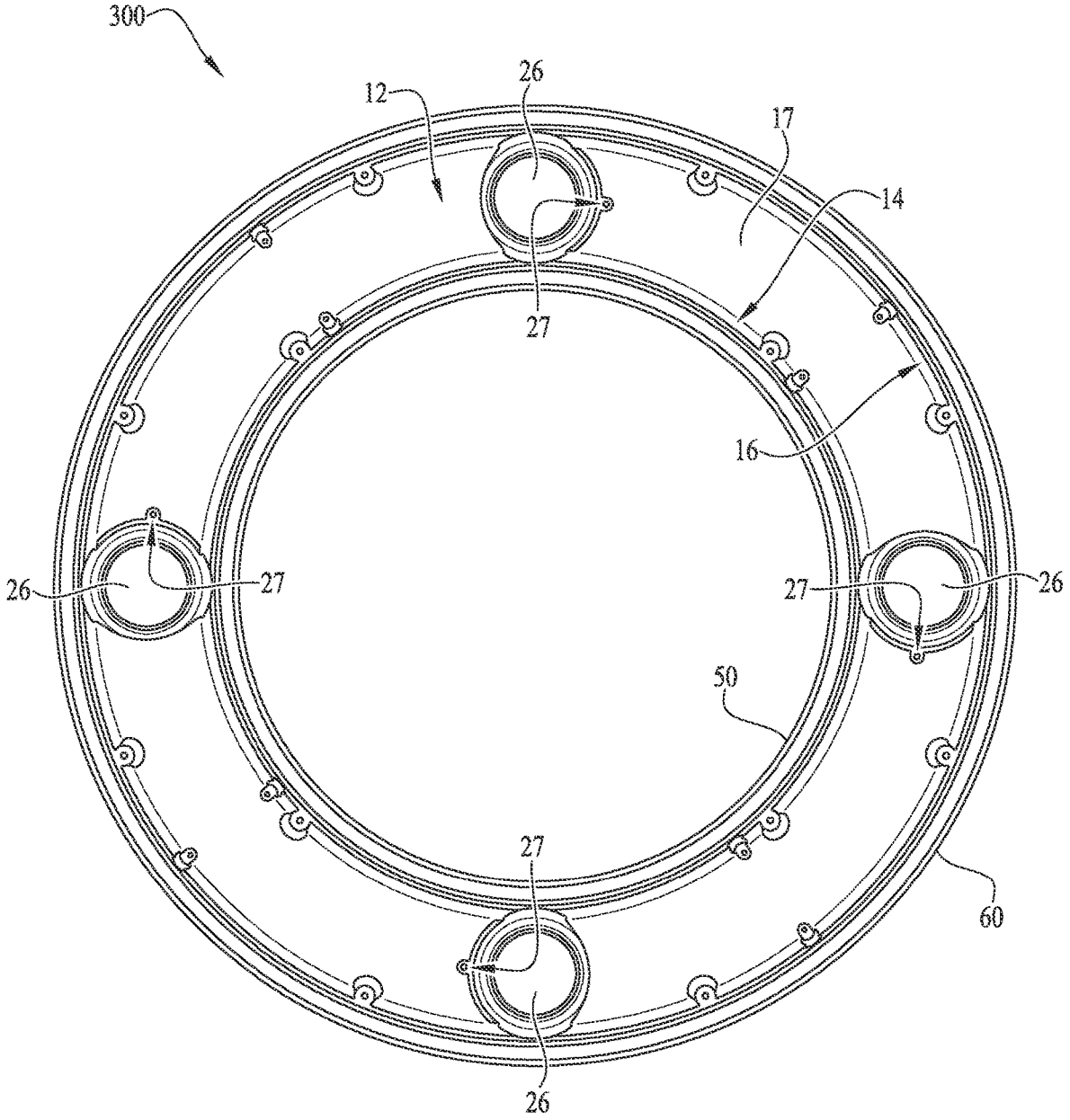
FIG. 20 is a top plan view of the third embodiment of FIG. 19, wherein the diverter plates and grid cover are removed.

FIG. 20 shows a fully disassembled drain 300. The grid cover 22 and the diverter plates 302 have been removed, leaving just the drain 300 and its chamber 12, with four outlet ports 26.

Figure 21:
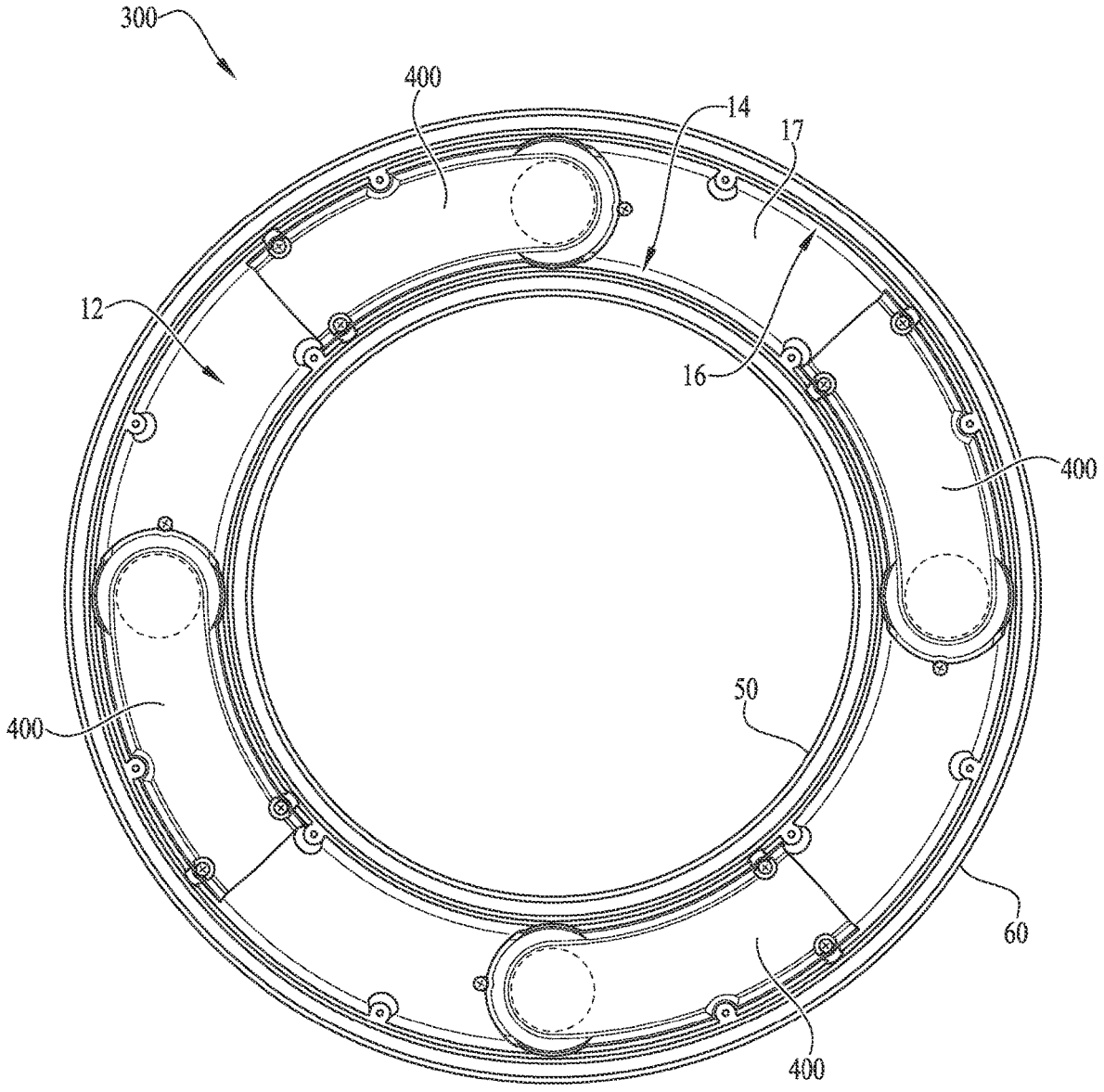
FIG. 21 is a top plan view of the third embodiment of FIG. 20, wherein the diverter plates as positioned inside the drain.

FIG. 21 shows the diverter plates 400 re-installed in the chamber 12 of the fully disassembled drain 300. As discussed above, there is a diverter plate 400 positioned over each outlet port 26.

Figure 22:
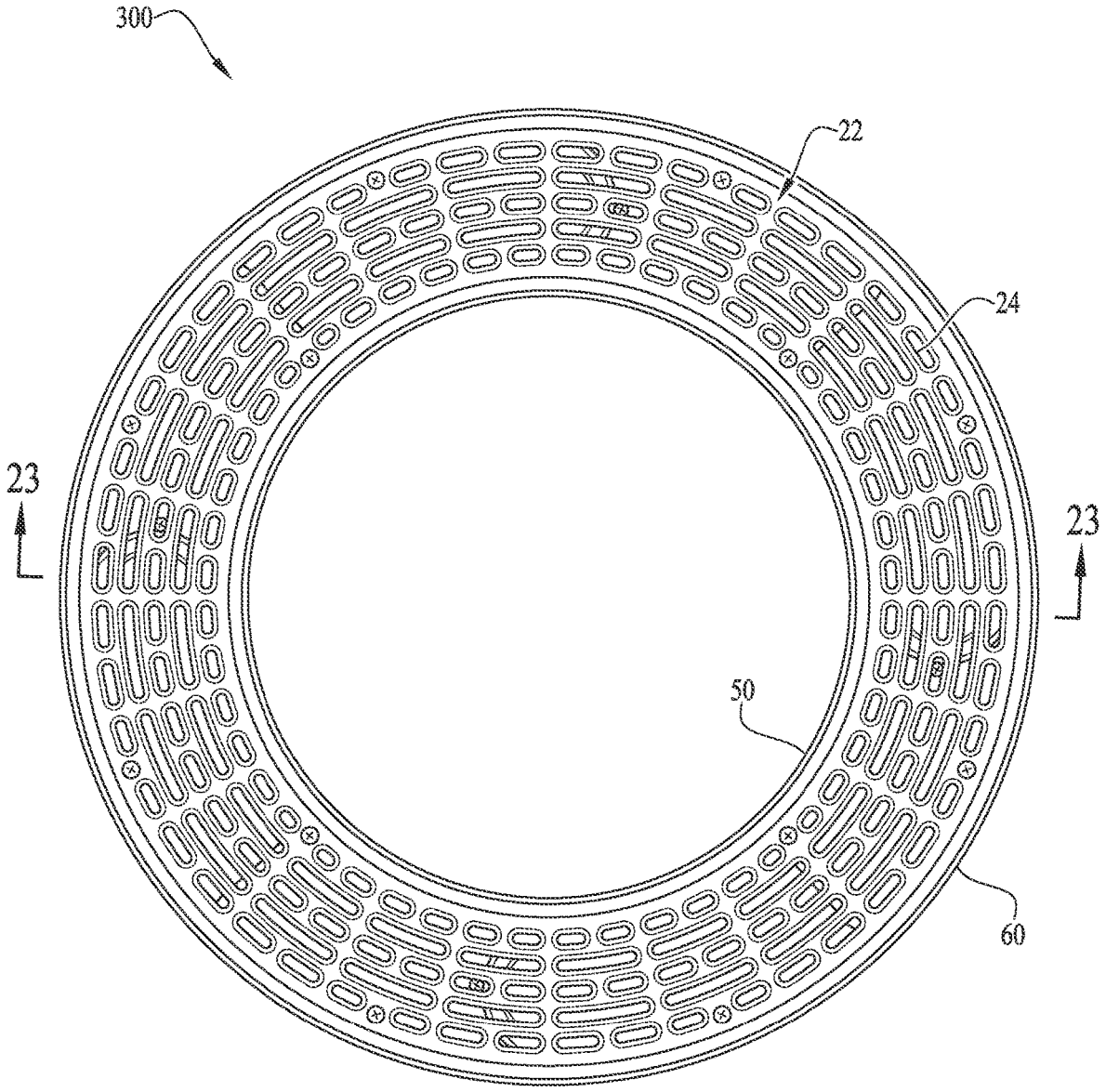
FIG. 22 is a top plan view of the third embodiment of FIG. 20, wherein the grid cover is positioned on the drain.

FIG. 22 shows the drain 300 fully re-assembled, where the grid cover 22 has been placed over the chamber 12.

Figure 23:
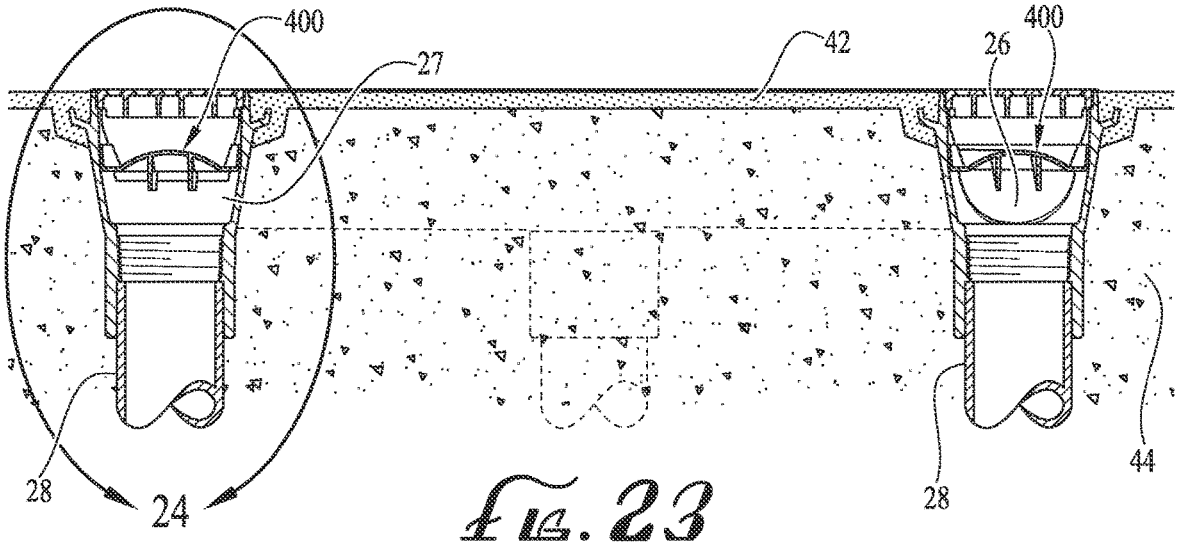
FIG. 23 is a section view taken from FIG. 22 along line 23-23.
Figure 24:
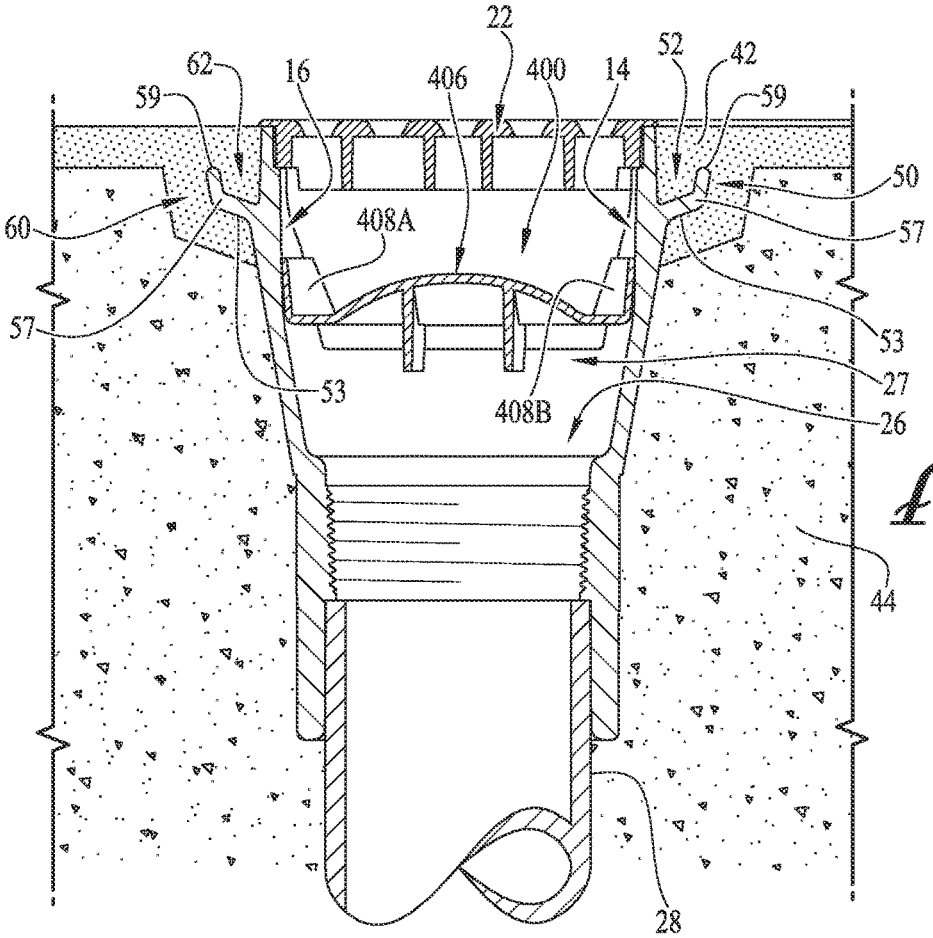
FIG. 24 is an enlarged portion of FIG. 23, wherein the diverter plate position is shown.

FIGS. 23 and 24 are cut-away views of the fully re-assembled drain 300. Placement of the diverter plates 400 over the outlet ports 26 can be seen. FIG. 23 provides a good view of the placement of rear wall 27 of the outlet port 26, which can be seen on left-side cutout and is missing from the right-side cutout (because of where the cross-section was taken).

FIGS. 23 and 24 also show water stops 50, 60 for stopping any water that intrudes between the drain 300 and plaster 42 into which the drain 300 is embedded. In the preferred embodiment the water stop 50, 60 is two gutters or channels 52, 62, wherein water stop 60 extends around an exterior surface of the drain 300 and water stop 50 extends around an interior surface of the drain 300. Both water stops 50, 60 are configured to collect water seeping into cracks between the drain 300 and the plaster 42. Water stops 50 and 60 also serve to anchor the drain 300 in the plaster 42. Water stop 50 (and gutter or channel 52) is located inboard the grid cover 22 and is molded into an exterior surface of chamber side wall 14. Water stop 60 is located outboard the grid cover 22, as the gutter or channel 52 is molded into an exterior surface of chamber side wall 16 adjacent to the screws 36 which attach the cover 22. Each water stop 50, 60 preferably includes a bottom surface 53 that is angled slightly inward from top to bottom, with bottom being proximate the drain 300, and a slightly angled side wall 55, similarly oriented wherein a bottom 57 of the side wall 55 is proximate the drain 300, and a top 59 of the side wall 55 is distal the drain 300.

Figure 25:
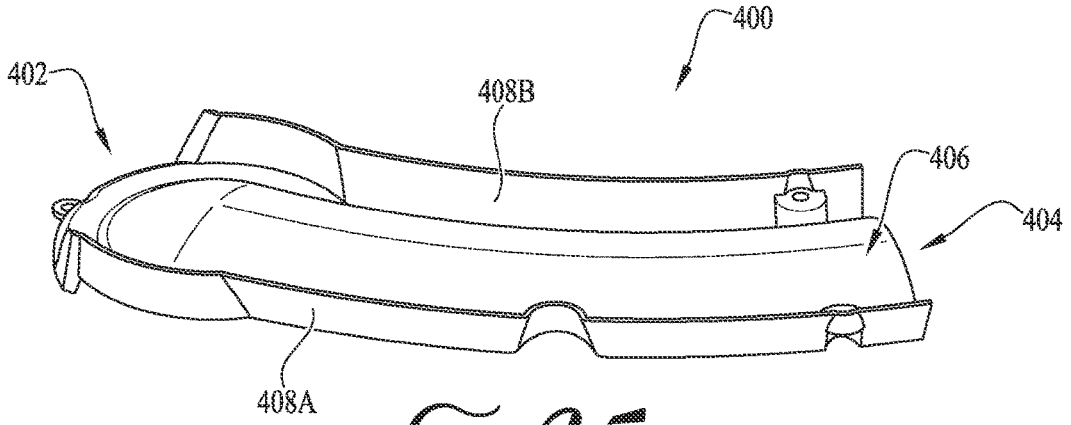
FIG. 25 is perspective view of a first diverter plate embodiment.
Figure 26:
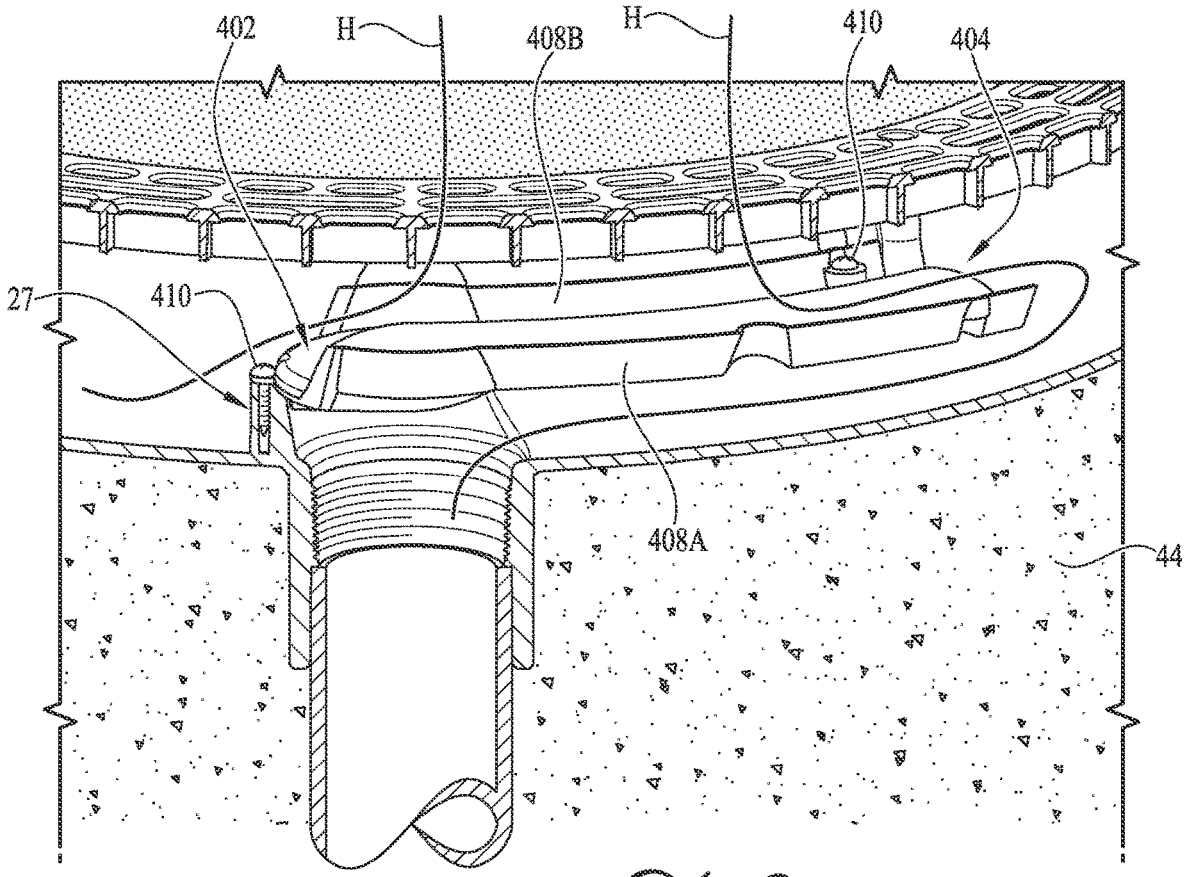
FIG. 26 is an enlarged portion the third drain embodiment, wherein the function of the first diverter plate embodiment is shown.

FIGS. 25 and 26 show a first diverter plate embodiment 400. In this diverter plate 400, the diverter plate 400 is curved to follow the curved contours of the chamber 12 in which it must fit. The diverter plate 400 has a rounded end 402 and a straight or flat end 404. The rounded end 402 of the diverter plate 400 is configured to removably couple to the rear wall 27 of the corresponding outlet port 26. This effectively seals off one side of the outlet port 26 so that hair can only enter the outlet port 26 from one direction.

At least a portion of a bottom surface 406 of diverter plate 400 is convex along its center axis and this is best seen in FIGS. 23 and 24. Preferably, the entire bottom surface 406 is convex, as shown in Figures. The diverter plate 400 has two side walls 408A, 408B that extend upward, away from opposed sides of the convex bottom surface 406. The side walls 408A, 408B are configured to leave little to no gap between the side walls 408A, 408B of the diverter plate 400 and the sidewalls 14, 16 of the chamber 12. This configurations means that hair, labeled H in FIG. 26, can only enter the outlet port 26 below the diverter plate 400 via one entrance which is under the straight end 404 of the diverter plate 400. This is shown in FIG. 26. Optionally, at least a portion of the bottom surface 406 of the diverter plate 400 is concave, or optionally, the entire bottom surface 406 of the diverter plate 400 is flat.

Three fasteners 410 are used to secure the diverter plate 400 to the interior of the chamber 12, one fastener 410 located at the rounded end 402 of the diverter plate 400 and the other two fasteners 410 are opposed each other, along the side walls 408A, 408B of the diverter plate 400. All three fasteners 410 can be seen in FIG. 19, as FIG. 26 only shows two fasteners 410. Optionally, there can be more than three fasteners 410 used to removeably couple the diverter plate 400 to the sidewalls 14, 16 of the chamber 12.

Figure 27:
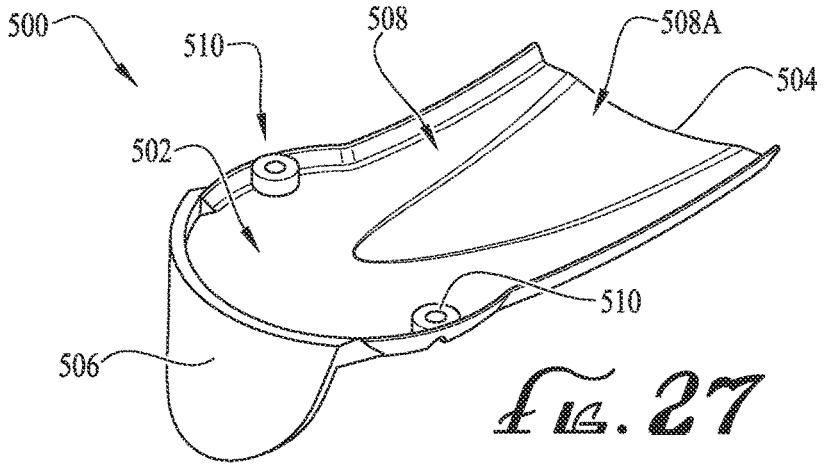
FIG. 27 is a perspective view of a second diverter plate embodiment.
Figure 28:
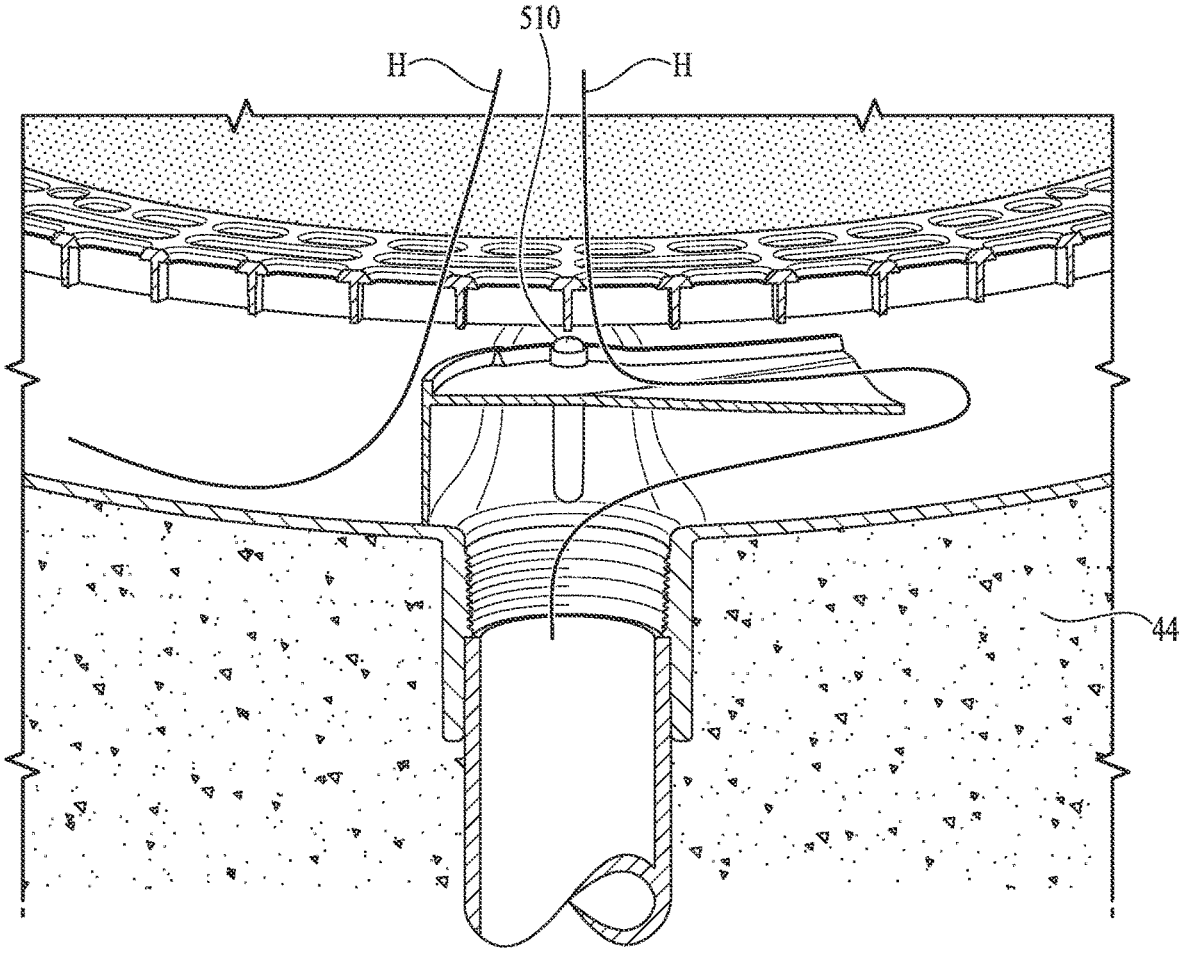
FIG. 28 is an enlarged portion of the third drain embodiment, wherein the function of the second diverter plate embodiment is shown.

FIGS. 27 and 28 show a second diverter plate embodiment 500. In this embodiment, the diverter plate 500 has a rounded end 502 and a straight or flat end 504, but the plate 500 is shorter in length than the first diverter plate embodiment 400. The rounded end 502 has an end wall 506 that projects downward, towards the outlet port 26, and prevents hair, labeled H in FIG. 28, from curving under the rounded end 502 and entering the corresponding outlet port 26. In this embodiment, the outlet ports 26 of the drain 300 do not have rear walls 27. As such, end wall 506 on the diverter plate 500 is necessary to block off one entrance to the outlet port 26. Optionally, drain 300 has rear walls 27 at each outlet port 26, and diverter plate 500 does not have end wall 506 and rounded end 502 is configured like rounded end 402 on the first diverter plate 400.

This diverter plate 500 has a bottom surface 508 with at least portion of the bottom surface 508A being concave rather than convex like the first diverter plate embodiment 400. Optionally, at least a portion of the bottom surface 508 of the diverter plate 500 is convex, or optionally, the entire bottom surface 508 of the diverter plate 500 is flat. There are two fasteners 510 used to secure the second embodiment 500 to the chamber 12 that are located on opposing sides of the rounded end 502 of the diverter plate 500. Optionally, only one fastener 510 can be used or, more than two fasteners 510 can be used.

Figure 29:
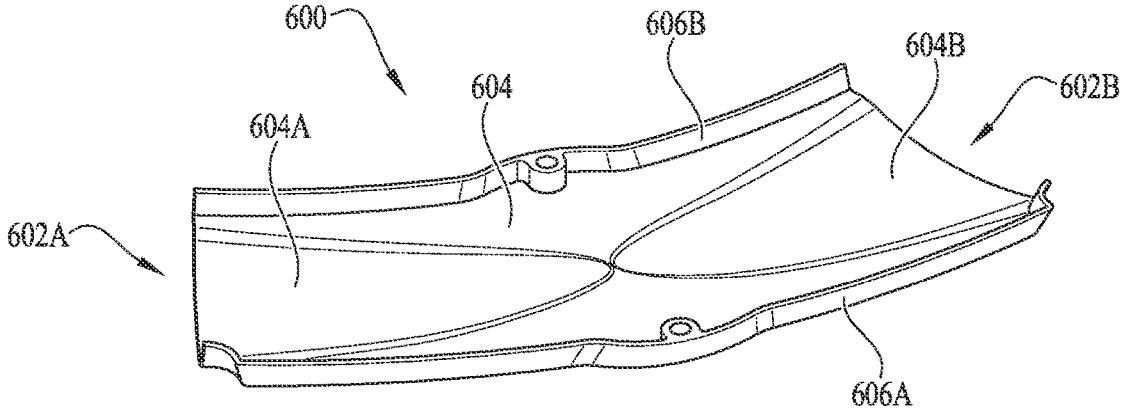
FIG. 29 is a top perspective view of a third diverter plate embodiment.
Figure 30:
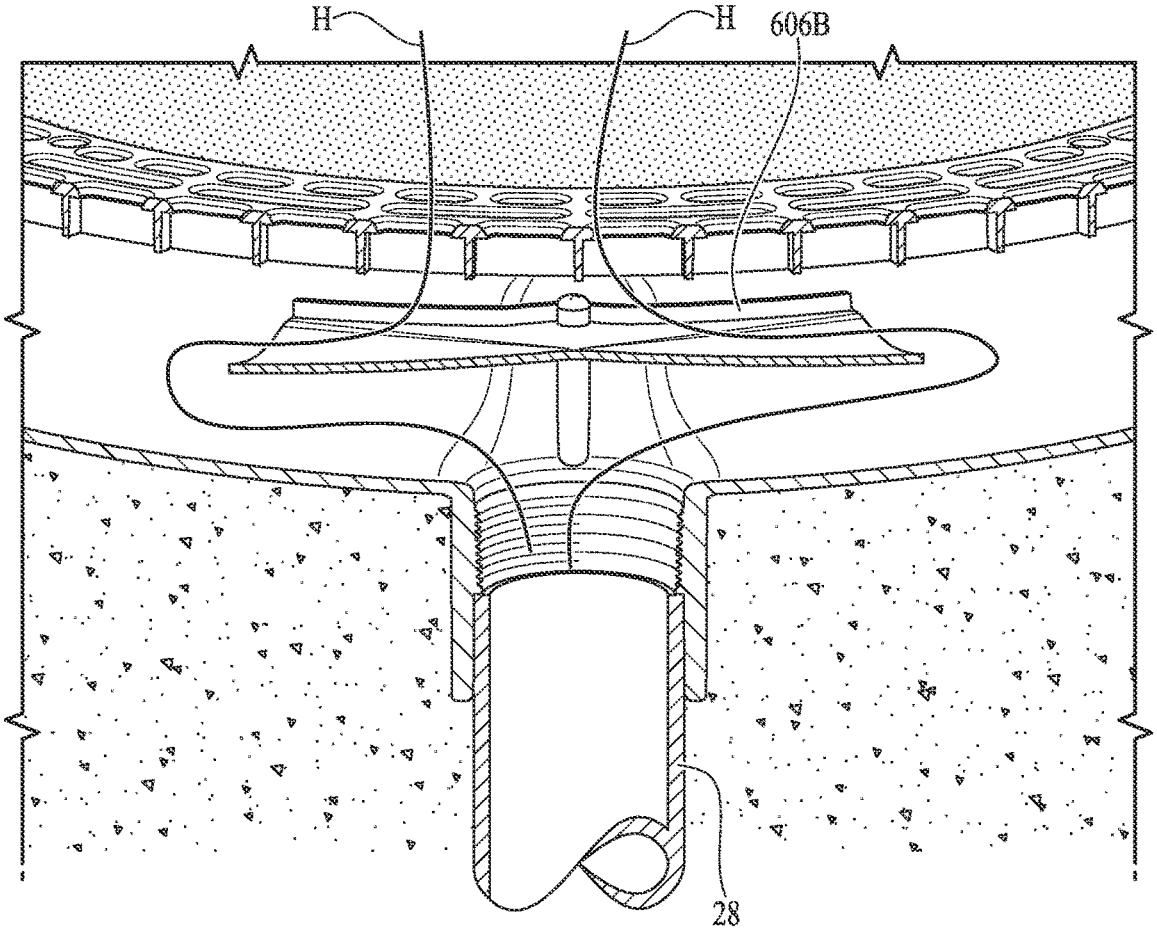
FIG. 30 is an enlarged portion of the third drain embodiment, wherein the function of the third diverter plate embodiment is shown.

FIGS. 29 and 30 show a third diverter plate embodiment 600. In this embodiment 600, hair, labeled H in FIG. 30, is permitted to access the corresponding outlet port 26 from both ends of the diverter plate 600 as the diverter plate 600 has two opposed straight ends 602A, 602B. In this embodiment 600, the diverter plate 600 is also curved to follow the curvature of the chamber 12 in which the diverter plate 600 must fit. Additionally, a portion 604A of a bottom surface 604 of diverter plate 600 is concave and the diverter plate 600 has two side walls 606A, 606B that extend upward, away from opposed sides of the bottom surface. Optionally, at least a portion of the bottom surface 604 of the diverter plate 600 is convex, or optionally, the entire bottom surface 604 of the diverter plate 600 is flat.

Figure 31:
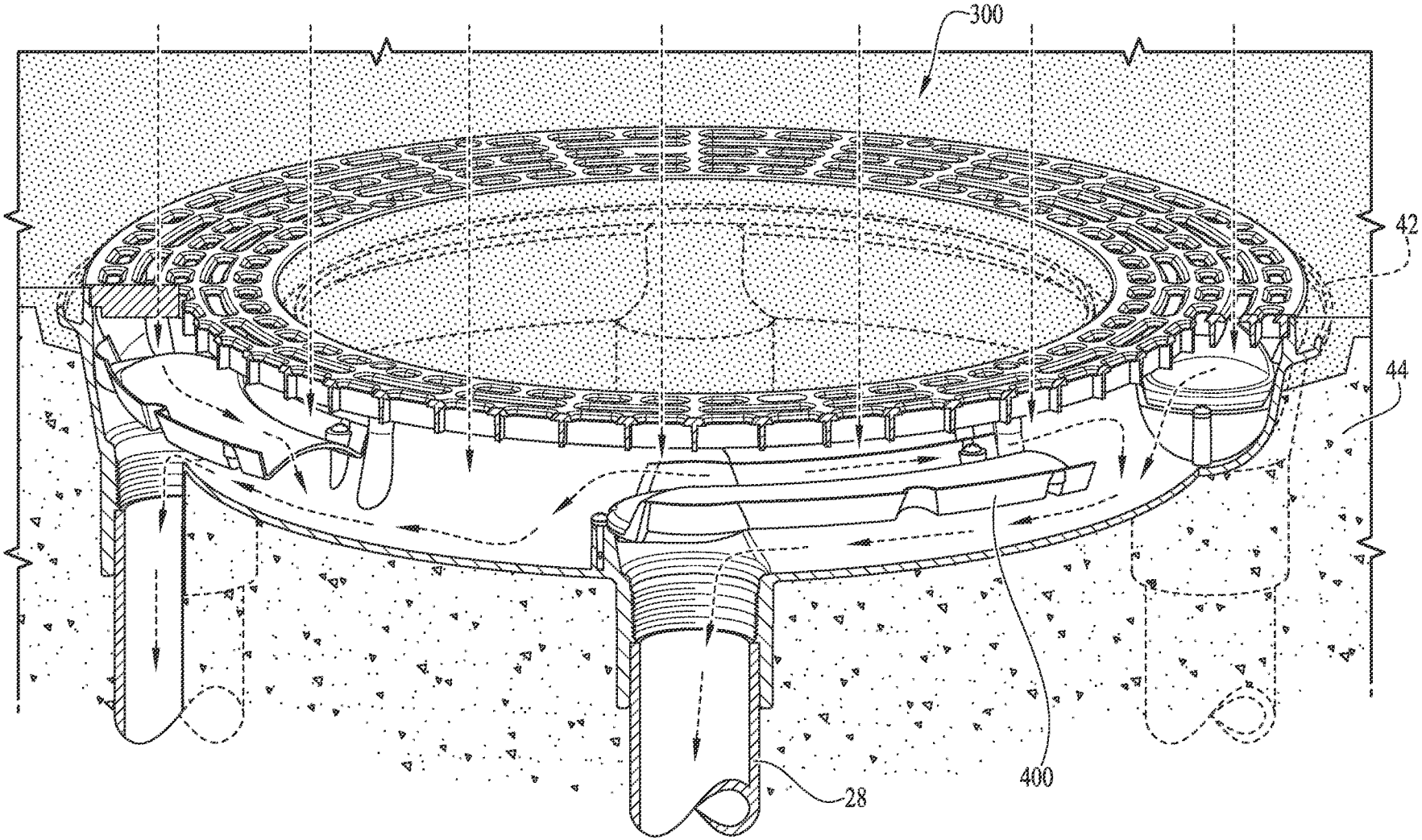
FIG. 31 is a section view of the third drain embodiment, wherein the flow path of the water is shown when the diverter plates are in use.
Figure 32:
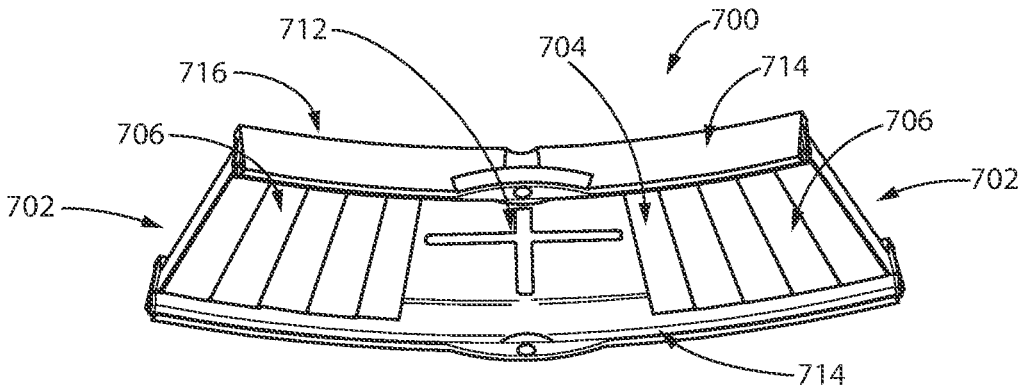
FIG. 32 is a perspective view of a fourth diverter plate embodiment.
Figure 33:
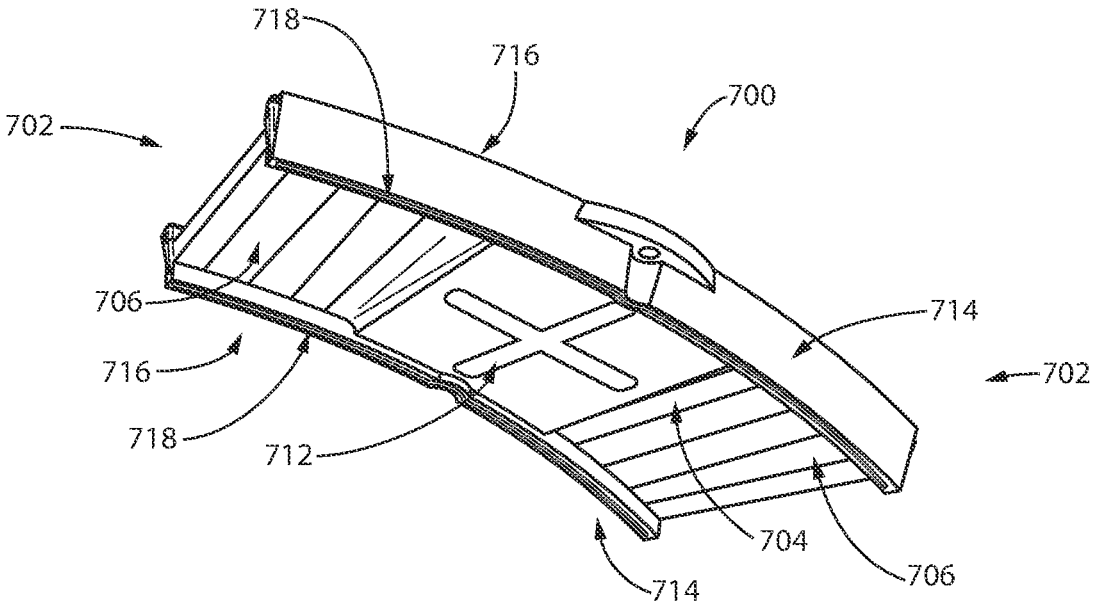
FIG. 33 is a bottom perspective view of the fourth diverter plate of FIG. 32.

FIG. 31 shows the third drain embodiment 300 installed in a pool surface 42 in much the same fashion that the first and second drain embodiments 10, 110 are installed. Optionally, the drain 300 may also be installed vertically in a lower wall of a pool or spa (not shown). Like the first and second embodiments 10, 110, there is a substantial amount of plaster 42, as well as the underlying gunite or shotcrete material 44, between the inner side walls 14 of the annular chamber 12. With the drain 300 being installed in this fashion, it offers improved structural integrity in that any load from a swimmer's foot or occupant of a hot tub will impact only a small portion of the drain 300 and tend to be absorbed by the surrounding floor or wall of the pool or spa.

The flow of water is shown by the arrows in FIG. 31, where water enters the annular chamber 12 through the grid cover 22. The diverter plates 400 divert water and only allow water to enter one side of each outlet port 26. This prevents dangerous tangling of hair that can take place if hair is allowed unfettered access to the outlet ports 26. Because the rounded ends 402 of the diverter plates 400 do not have a back wall, water that is not diverted under the straight end 404 of the diverter plate 400 is free to continue along the circular path created by the annular chamber 12 until the water reaches another diverter plate 400 that permits the water to access the corresponding outlet port 26.

Figure 34:
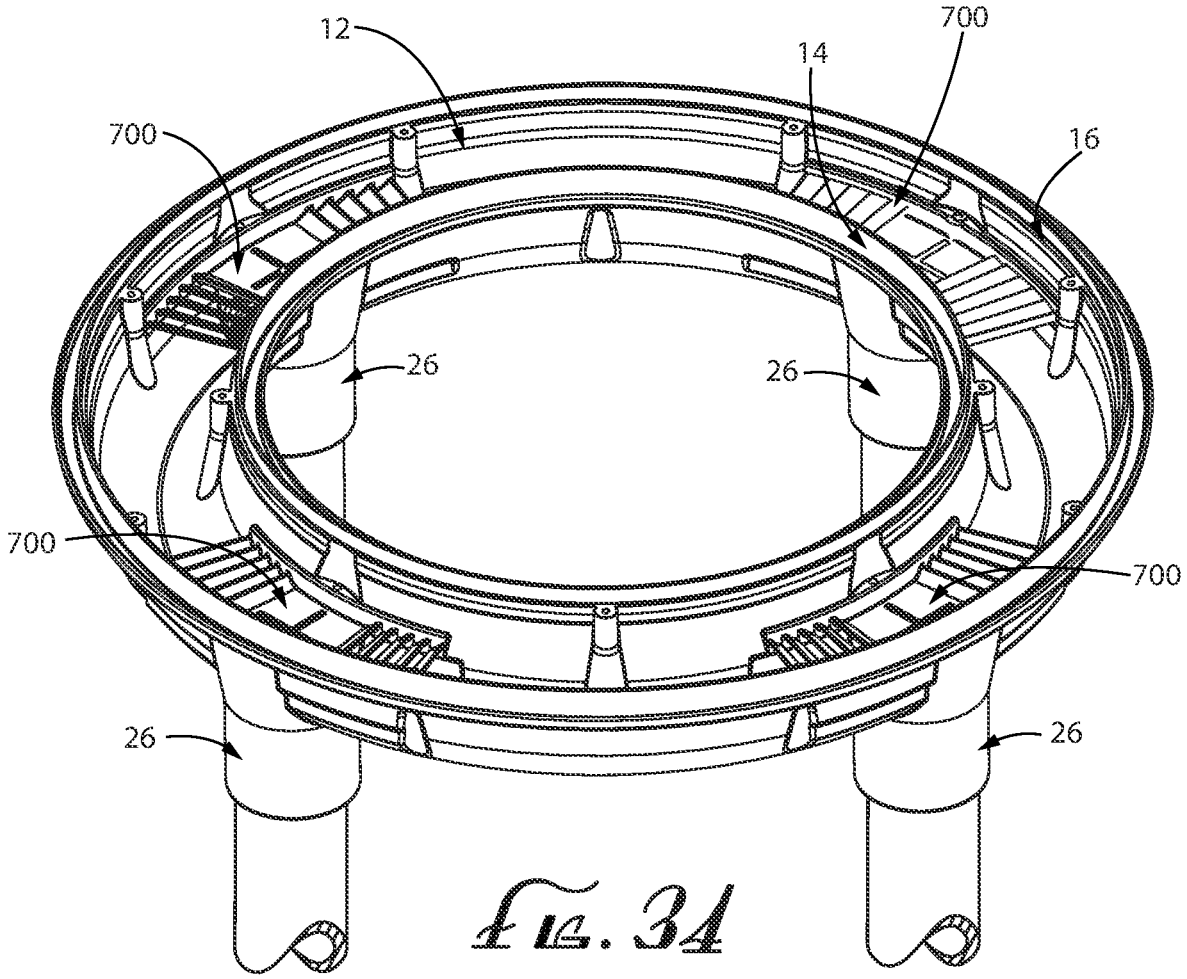
FIG. 34 is a perspective view of the fourth diverter plate embodiment of FIG. 32, shown installed in a circular drain.
Figure 35:
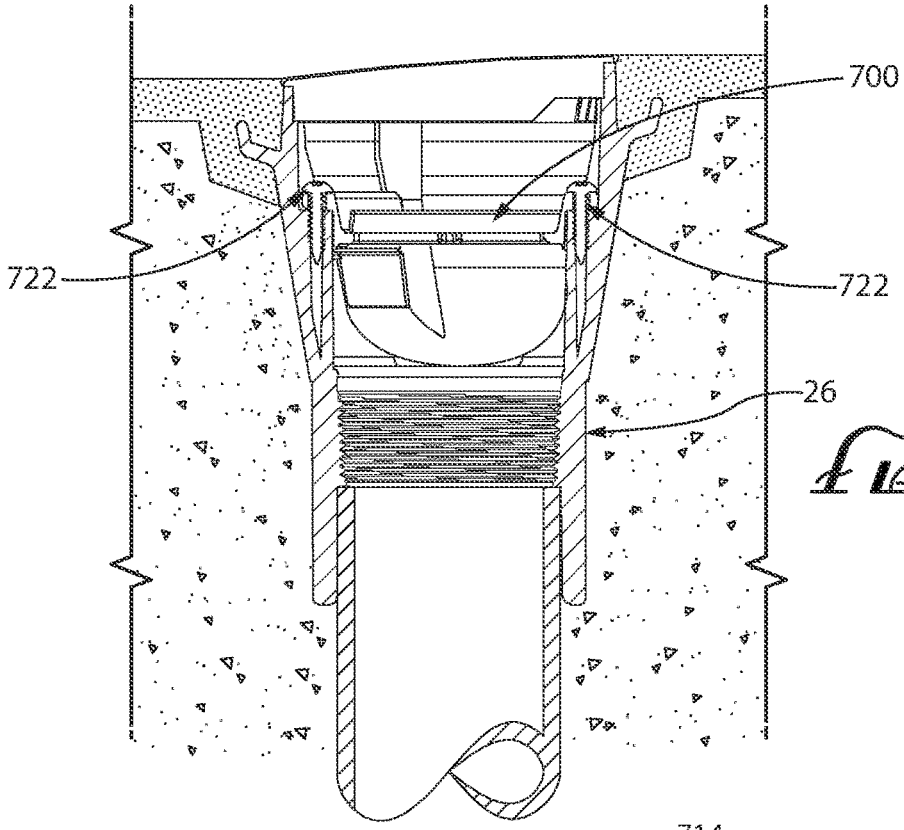
FIG. 35 is an enlarged sectional view of the fourth diverter plate embodiment installed in the circular drain of FIG. 34.
Figure 36:
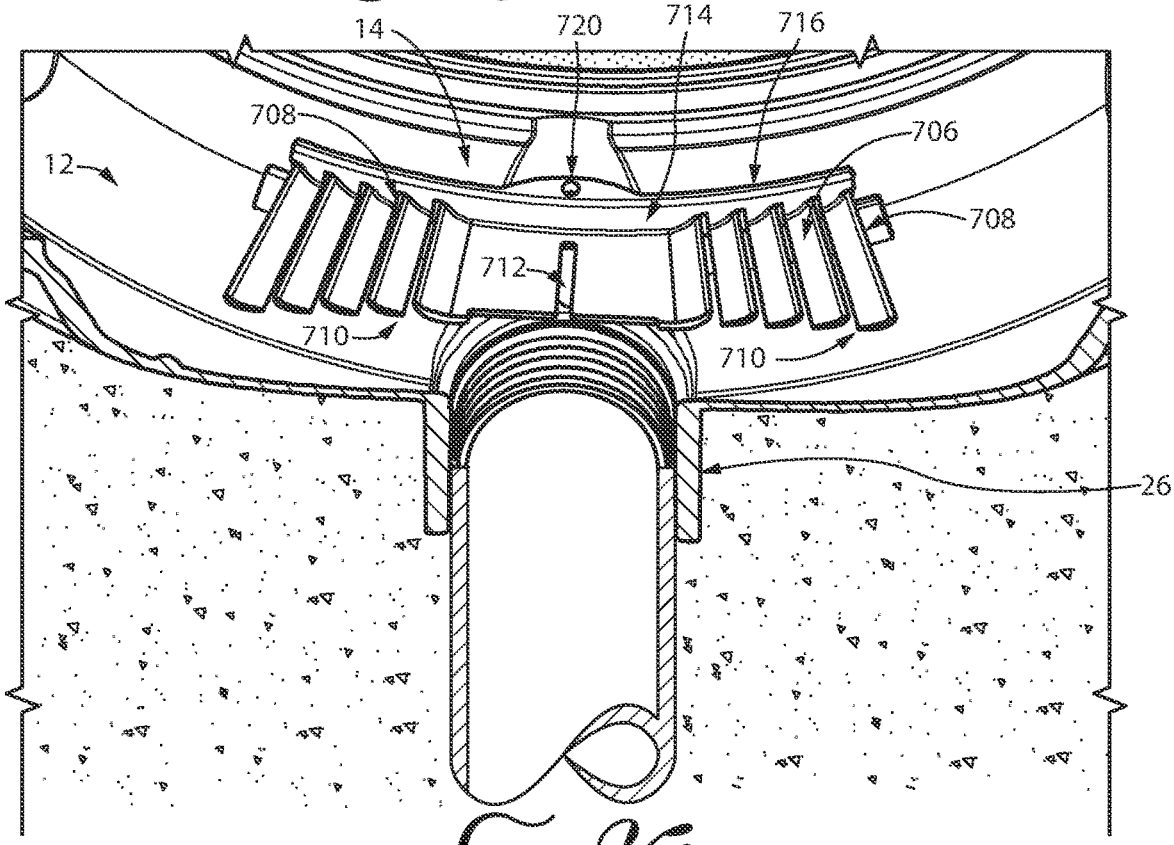
FIG. 36 is an additional enlarged sectional view of a portion of FIG. 34.

Referring now to FIGS. 32-36, there is shown a fourth diverter plate embodiment 700. In this embodiment, the diverter plate 700 has two opposed ends 702 joined together by a louvered bottom surface 704. The ends 702 can be any shape, including straight/flat, or curved, either convex or concave, or some other shape. The ends 702 shown in the figures are straight/flat. By louvered it is meant that the bottom surface 704 comprises a plurality of angled slats or flat strips 706 fixed or hung at regular intervals along the bottom surface 704 to allow water to pass through. The louvers 706 each comprise a top surface 708 and a bottom surface 710, which is best seen in FIG. 36. Optionally, the plate 700 does not have ends 702 per se, and instead, the last louvers 706 on either end of the plate 700 for the "ends" 702 of plate.

The bottom surface 704 is generally planar in shape, however, the bottom surface 704 can be any shape, including concave, convex, or some combination of convex, concave and planar.

Optionally, the bottom surface 704 can further comprises a central opening 712, which as shown in the drawings, is in the shape of a cross. However, the central opening 712 can be any shape and is not limited to the cross-shape shown in the drawings.

The plate 700 also comprises a pair of parallel, opposed side walls 714 that are slightly curved to match up with the curved walls of the drain into which the plate 700 is installed. Each side wall 714 has a top surface 716 and a bottom surface 718, relative to the corresponding top and bottom surfaces of the drain into which the plate 700 is installed. The side walls 714 are configured to leave little to no gap between the side walls 714 of the diverter plate 700 and the sidewalls 14, 16 of the chamber 12. This configurations means that hair can only enter the outlet port 26 below the diverter plate 700 by passing through the diverter plate 700, and due to the louvers 706, the flow of hair into the outlet port 26 is disrupted, making it harder for the hair to tangle and get caught.

Optionally, each side wall 714 can extend above the top surface 708 of the louvers 706 such that the louvers 706 are recessed below the top surface 716 of the side walls 714, which is best seen in FIG. 36. However, the recession of the louvers 706 relative to the side walls 714 is not required. The top surfaces 708 of the louvers 706 can be flush with, or extend above, the top surface 716 of the side walls 714. Optionally, the top surface 708 of each louver 706 can be positioned at different heights relative to the top surfaces 708 of the other louvers 706 such that all top surface 708 of all louvers 706 are not positioned at the same height with respect to each other.

Each side wall 714 also comprises a fastener opening 720 for use with a fastener 722 to secure the plate 700 to the drain. The fastener 722 can be any type of known fastener, such as screw, bolt, rivet, nail, or glue.

Referring now to FIG. 34, a plurality of plates 700 are shown installed in a circular drain, and the circular drain can be any circular drain disclosed in this application. The plates 700 are positioned above the outlet ports 26 of the drain. If the drain has more than one outlet port 26, four in the case of FIG. 34, then a diverter plate 700 is positioned over each outlet port 26 to prevent hair from tangling into the outlet port 26.

FIG. 35 shows an enlarged sectional view of FIG. 34, wherein the plate 700 has been cut along its width, and its position with respect to the outlet port 26 is shown in greater detail. The plate 700 is positioned above the corresponding outlet port 26 to prevent hair from directly entering and tangling within the outlet port 26. The side walls 714 are relatively flush with the side walls of the drain so that water (and any hair therein) is forced to pass through the plate 700 in order to exit the drain.

FIG. 36 shows an additional enlarged sectional view of a portion of FIG. 34, wherein the plate 700 has been cut along its length, and its position with respect to the outlet port 26 is shown in greater detail. As in FIG. 36, the plate 700 is positioned above the corresponding outlet port 26 to prevent hair from directly entering and tangling within the outlet port 26. The central opening 712 is centered over the outlet port 26 and the louvers 706 extend on either side of the outlet port 26.

While the apparatus and method have been described in detail with reference to specific embodiments thereof, it will be apparent to one skilled in the art that various changes and modifications can be made therein, without departing from the spirit and scope thereof. Thus, it is intended that the present description cover that modifications and variations of the apparatus and method provided, while it is only the appended claims and their equivalents which define the scope of the invention.

What is claimed is:

1. A sump drain for installation in a surface of a swimming pool or spa having a drain inlet, the sump drain comprising:

a) an annular chamber having a contiguous annular top opening formed by an inner side wall, an outer side wall and a bottom surface;

b) a plurality of outlet ports spaced along the bottom surface of the chamber;

c) an inner water stop and an outer water stop, the inner water stop coupled to an exterior surface of the inner wall of the chamber and the outer water stop coupled to an exterior surface of the outer wall of the chamber, the water stops configured to collect water seeping into cracks between the drain and plaster when the drain is installed, d) a plurality of diverter plates configured to removeably couple to the inner and outer side walls of the annular chamber, wherein each diverter plate is curved along its length and has:

i) two opposed straight ends;

ii) a bottom surface having a plurality of louvers; and iii) a pair of side walls extending from opposed sides of the bottom surface;

wherein one diverter plate is placed over each outlet port; and e) a grid cover configured to removeably couple to the annular top opening of the chamber, the grid cover having a multiplicity of openings.

2. The sump drain of claim 1 wherein the plurality of outlet ports extend downward from the bottom surface of the annular chamber.

3. The sump drain of claim 1, further comprising a central opening in the bottom surface of the diverter plate.

4. The sump drain of claim 3, wherein the central opening is in the shape of a cross.

5. The sump drain of claim 1, further comprising two fasteners for coupling the diverter plate to the annular chamber.

6. The sump drain of claim 1, wherein each water stop has:

a) a bottom surface that is angled slightly inward from top to bottom, with bottom being proximate the drain; and b) a slightly angled side wall wherein a bottom of the side wall is proximate the drain and a top of the side wall is distal the drain.

7. A diverter plate for installation in a circular sump drain above an outlet port, the diverter plate being curved along its length and comprising:

a) two opposed ends;

b) a bottom surface having a plurality of louvers; and c) a pair of side walls extending from opposed sides of the bottom surface.

8. The diverter plate of claim 7, further comprising a central opening in the bottom surface of the diverter plate.

9. The diverter plate of claim 8, wherein the central opening is in the shape of a cross.

10. The diverter plate of claim 7, further comprising two fasteners for coupling the diverter plate to a sump drain.

11. A sump drain for installation in a surface of a swimming pool or spa having a drain inlet, the sump drain comprising:

a) an annular chamber having a contiguous annular top opening formed by an inner side wall, an outer side wall and a bottom surface;

b) at least one outlet port along the bottom surface of the chamber;

c) at least one diverter plate configured to removeably couple to the inner and outer side walls of the annular chamber, wherein the diverter plate is curved along its length and has:

i) two opposed ends;

ii) a bottom surface having a plurality of louvers; and iii) a pair of side walls extending from opposed sides of the bottom surface;

wherein the diverter plate is placed over the outlet port; and d) a grid cover configured to removeably couple to the annular top opening of the chamber, the grid cover having a multiplicity of openings.

12. The sump drain of claim 11, further comprising an inner water stop and an outer water stop, the inner water stop coupled to an exterior surface of the inner wall of the chamber and the outer water stop coupled to an exterior surface of the outer wall of the chamber, the water stops configured to collect water seeping into cracks between the drain and plaster when the drain is installed.

13. The sump drain of claim 11, wherein the drain comprises a plurality of outlet ports and a plurality of diverter plates.

14. The sump drain of claim 11, further comprising two fasteners for coupling the diverter plate to the annular chamber.

* * * * *